US010898947B2

(12) United States Patent
Darlington, Jr. et al.

(10) Patent No.: US 10,898,947 B2
(45) Date of Patent: Jan. 26, 2021

(54) PROCESSES FOR RECOVERING SAND AND ACTIVE CLAY FROM FOUNDRY WASTE

(71) Applicant: AMCOL INTERNATIONAL CORPORATION, Hoffman Estates, IL (US)

(72) Inventors: Jerald W. Darlington, Jr., Marengo, IL (US); Elliot Francis Halphen, New Iberia, LA (US); Liam Matthew Miller, Elgin, IL (US)

(73) Assignee: AMCOL INTERNATIONAL CORPORATION, Hoffman Estates, IL (US)

( * ) Notice: Subject to any disclaimer, the term of this patent is extended or adjusted under 35 U.S.C. 154(b) by 61 days.

(21) Appl. No.: 16/325,384

(22) PCT Filed: Aug. 15, 2017

(86) PCT No.: PCT/US2017/046980

§ 371 (c)(1),
(2) Date: Feb. 13, 2019

(87) PCT Pub. No.: WO2018/038977

PCT Pub. Date: Mar. 1, 2018

(65) Prior Publication Data

US 2019/0193142 A1 Jun. 27, 2019

Related U.S. Application Data

(60) Provisional application No. 62/378,117, filed on Aug. 22, 2016.

(51) Int. Cl.

| | |
|---|---|
| ***B03B 9/04*** | (2006.01) |
| ***B22C 5/18*** | (2006.01) |
| ***B03B 9/00*** | (2006.01) |

(52) U.S. Cl.

CPC ..... *B22C 5/185* (2013.01); *B03B 9/00* (2013.01); *B03B 9/04* (2013.01)

(58) Field of Classification Search

CPC .... B03B 5/04; B03B 5/28; B03B 7/00; B03B 9/04; B03B 9/00; B22C 5/18; B22C 5/185; B02C 23/20

See application file for complete search history.

(56) References Cited

U.S. PATENT DOCUMENTS 4,144,088 A * 3/1979 Adams ..... B22C 5/18 134/17
4,251,358 A * 2/1981 Mozley ..... B03B 5/26 209/437

(Continued)

FOREIGN PATENT DOCUMENTS

EP 2 191 909 A1 6/2010

OTHER PUBLICATIONS

International Preliminary Report on Petentability of PCT/US2017/046980 dated Mar. 7, 2019, 8 pages.

(Continued)

*Primary Examiner* — Joseph C Rodriguez
(74) *Attorney, Agent, or Firm* — Squire Patton Boggs (US) LLP

(57) ABSTRACT

A process of recovering clean sand and active clay from sand or dust from a foundry is disclosed.

10 Claims, 11 Drawing Sheets

(56) References Cited

U.S. PATENT DOCUMENTS 4,449,566 A * 5/1984 Filipovitch ..... B22C 5/18 164/5
4,671,867 A * 6/1987 Battie ..... B03B 4/02 209/3
5,219,123 A * 6/1993 Jacob ..... B22C 5/18 241/5
5,436,384 A * 7/1995 Grant ..... B03B 9/00 209/17
5,520,341 A * 5/1996 Boenisch ..... B22C 5/02 241/41
5,540,270 A * 7/1996 Grote ..... B03B 9/00 164/5
6,516,863 B2 * 2/2003 McVane ..... B22C 5/0463 164/412
6,834,706 B2 * 12/2004 Steele ..... B22C 5/185 164/131
7,172,143 B2 * 2/2007 Vandeputte ..... B03B 5/28 209/3
9,061,288 B2 * 6/2015 Danko ..... B22C 5/085
2003/0029592 A1 2/2003 Steele et al.
2003/0145972 A1 8/2003 Steele et al.
2007/0125508 A1 * 6/2007 McVane ..... B01F 13/1027 164/15
2008/0202986 A1 8/2008 Fontaine

OTHER PUBLICATIONS

International Search Report and the Written Opinion of PCT/US2017/046980 dated Nov. 30, 2017, 11 pages.
Notification of the First Office Action dated Mar. 20, 2020 of Chinese Patent Application No. 201780051476.X and its English translation; 16 pages.

* cited by examiner

Bonding Sand Particles with Active and "Dead" Bentonite Clay Particles

- Less bentonite clay particles
- More water sorption and swelling
- More binding strength

- More bentonite clay particles
- Less water sorption and swelling
- Less binding strength

PROCESSES FOR RECOVERING SAND AND ACTIVE CLAY FROM FOUNDRY WASTE

BACKGROUND OF THE INVENTION

Field of the Invention

This invention relates to processes for recovering sand and clay from foundry waste for reuse in the foundry.

Description of the State of the Art

Green sand casting is a process for forming cast metal articles. In this process, a casting mold for making castings, formed from molding material that is primarily sand and bentonite clay, is used in only one molding cycle for the production of one or multiple castings. After the casting solidifies in the mold, the mold is broken down and the casting cycle is complete. A portion of the molding media can be recycled for another casting process, however, some of the molding media exits the foundry as foundry waste.

In foundries a casting mold is made using a green sand mold that defines the external body of the casting and a core that is placed inside the green sand mold to define the internal configuration of the casting. In the molding process, a molding media is used to form green sand molds and cores used in a casting cycle within a green sand foundry. New silica sand and a chemical binder are used to produce cores in a core-forming process. The core must withstand high pressure during formation of the casting and is made by coating the particles of sand with the chemical binder. In the core forming process, the sand/chemical binder mixture is pre-formed according to the internal configuration of the desired casting and the chemical binder is then reacted to complete a high-tensile core.

New silica sand, bentonite clay, and organic additives are used to produce green sand molds in a mulling (mold forming) step. The green sand mold is made by press forming sand that is coated by a mixture of bentonite and organic additives. Water is added to hydrate the bond and causes the grains of sand to adhere to one another and take shape. The green sand molds typically comprise by weight, from about 86% to 90% sand, 8% to 10% bentonite clay, 2% to 4% organic additives, and 2% to 4% moisture.

The core is inserted into the green sand mold after the core and green sand mold are formed. Molten metal is poured into the green sand mold to produce a casting. After the molten metal solidifies, the casting undergoes "shake out", referring to breaking apart of the green sand mold and the core into small particles or clumps. During shake out, the particles of the core flow out of the solidified casting and become commingled with the particles from the green sand mold.

A portion of the materials that once made up the green sand molds and core is recycled to make green sand molds at the muller for a subsequent casting cycle. An excess portion of the materials that made up the green sand molds and core exits the process as "molding waste." The addition of prime sand at the muller compensates for the fine sand that is taken out of the process after each casting cycle.

Prime bentonite clay and prime organic additives compensate for the additional bond needed to coat the uncoated prime sand and also the uncoated sand that once made up the cores. The addition of prime bentonite clay and organic additives also compensates for molding material lost due to high temperature exposure.

The excess molding material or foundry waste which cannot be reused for subsequent casting cycles, is generated at several locations within the foundry. The composition and particle size distribution of foundry waste can vary depending upon the areas of the foundry in which it is collected. Foundry waste is generally classified in two broad categories, "molding waste" and "bag house dust" or "dust." The term "molding waste" refers to the excess molding material from broken down green sand molds and cores produced during shake out. Another source of foundry waste is generated by defective cores that never get used in the casting operation. Molding waste can include materials which fall from the conveyor system at various stages throughout the foundry. In many green sand foundries, the molding waste typically contains by weight from about 80% to about 90% sand, from about 6% to about 10% bentonite clay and from about 1% to about 4% organic additives. Molding waste includes sand that is coated with bond as well as individual particles of sand, bentonite and organic additives.

Attempts have been made to reduce the accumulation of molding waste by mechanically removing the bond from the sand so that the sand is sufficiently clean to be reused in the production of cores. In such processes the sand is recovered, but the bentonite clay, which costs several times more than sand on a weight basis, and the organic additives are discarded.

Another large source of foundry waste includes fine particles of sand, bentonite clay, organic additives, and debris collected in the foundry's air evacuation system. This source of foundry waste is commonly known in foundries as "bag house dust". Bag house dust contains substantially more bentonite clay than does molding waste. Bag house dust typically comprises from about 30% to about 70% sand, from about 20% to about 50, or from about 20% to about 70% bentonite clay and from about 10% to about 30% organic additives.

Accordingly, there is a need to reduce the amount of foundry waste exiting a green sand foundry. There is a need to develop improved processes to recover sand that has sufficient quality to be used in the foundry to make cores and green sand molds and which can yield quality castings in a subsequent casting process and to recover sand, bentonite clay and organic additives to decrease the amount of prime materials that enter the foundry as raw material. Processes have been developed to recover sand that has sufficient quality to be used in the foundry to make cores and green sand molds and which can yield quality castings in a subsequent casting process. Processes have been developed to recover sand, bentonite clay and organic additives to decrease the amount of prime materials that enter the foundry as raw material.

SUMMARY OF THE INVENTION

Embodiments of the present invention include a method of reclaiming clean sand and active clay from foundry waste comprising: providing dust and sand from a molding process in a foundry, wherein the dust and sand comprise clay including active clay and dead clay; rinsing a slurry comprising the dust and sand to remove clay from the sand and dust, wherein the rinsing comprises rinsing the slurry at least one time, wherein the clay is separated as a first clay slurry; removing additional clay from the rinsed slurry by shaking the rinsed slurry on a shaker table, wherein the additional clay is separated as a second clay slurry, wherein a clean sand slurry is removed from an end of the shaker table; allowing the dead clay to separate as solids from the first and second clay slurry to form an active clay slurry; recycling the active clay slurry to a muller in a foundry; and recycling clean sand from the clean sand slurry to the foundry.

The present invention includes any one or any combination of the following aspects: wherein the slurry is formed in a slurry tank; wherein at least a portion of the active clay slurry is recycled to the slurry tank; wherein the slurry is 10 to 60 wt % solids; wherein the rinsing comprises rinsing the slurry only one time; wherein the rinsing comprises rinsing the slurry 2 to 5 times; wherein the rinsing and shaking is performed in a rinser/shaker unit; wherein at least one rinse is performed with fresh water; wherein at least one rinse is performed with the active clay slurry recycled to the rinsing; wherein the first and second clay slurry are fed to a flotation/settling tank to allow the dead clay to settle as solids; wherein the sand slurry is fed to a sand drier which removes water to form the clean sand for recycling to the foundry; wherein the clean sand is fed to a mechanical reclamation unit and then fed to core forming in the foundry; wherein the clean sand is fed to core forming in a foundry without mechanical reclamation; wherein a concentration of active clay in the clean sand is 1-3%; and wherein total clay concentration is about 2-6%.

Embodiments of the present invention include a method of reclaiming clean sand and active clay from foundry waste comprising: providing a composition from a molding process in a foundry, wherein the composition comprises sand, dust, or both (sand/dust) and clay incorporated with the sand/dust, wherein the clay includes active clay and dead clay; forming a first slurry comprising the composition and water; separating clay from the sand/dust in the first slurry to form a sand/dust slurry, wherein the separated clay is in a clay slurry; separating the dead clay from the clay slurry to form an active clay slurry; and recovering sand/dust from the sand/dust slurry.

The present invention includes any one or any combination of the following aspects: the composition provided is dry; further comprising recycling sand the recovered sand/dust slurry to the foundry; the clay is separated by rinsing the first slurry to remove clay from the sand/dust; the first slurry is rinsed with fresh water; the first slurry is rinsed with a portion of the active clay slurry; wherein the rinsing comprises spraying the first slurry at least one time; wherein the rinsing comprises spraying the first slurry 2 to 5 times; the dead clay is separated from the clay slurry by allowing the dead clay to separate as solids from the clay slurry; the clay slurry is fed to a settling tank where the dead clay separates as the solids; further comprising recycling the active clay slurry to a muller in the foundry; the first slurry is formed in a slurry tank prior to separating the clay from the sand/dust in the first slurry; the provided composition is fed in dry form to a rinser/shaker unit for the separation of the clay from the sand/dust in the first slurry; the first slurry is 10 to 60 wt % solids; the sand/dust slurry is fed to a sand drier which removes water to recover the sand/dust; the recovered sand is recycled to the foundry; the recovered sand is recycled to a mechanical reclamation unit and then fed to core forming in the foundry; the recovered sand is fed to core forming in a foundry without mechanical reclamation; a concentration of clay in the recovered sand is 1 to 3%; the provided composition is processed to reduce particle size prior to or during forming the first slurry; the provided composition is fed to a shaker and mill to reduce the particle size; and separating the clay comprises processing the first slurry in an attrition scrubber and classifier.

DETAILED DESCRIPTION OF THE INVENTION

Figure 1:
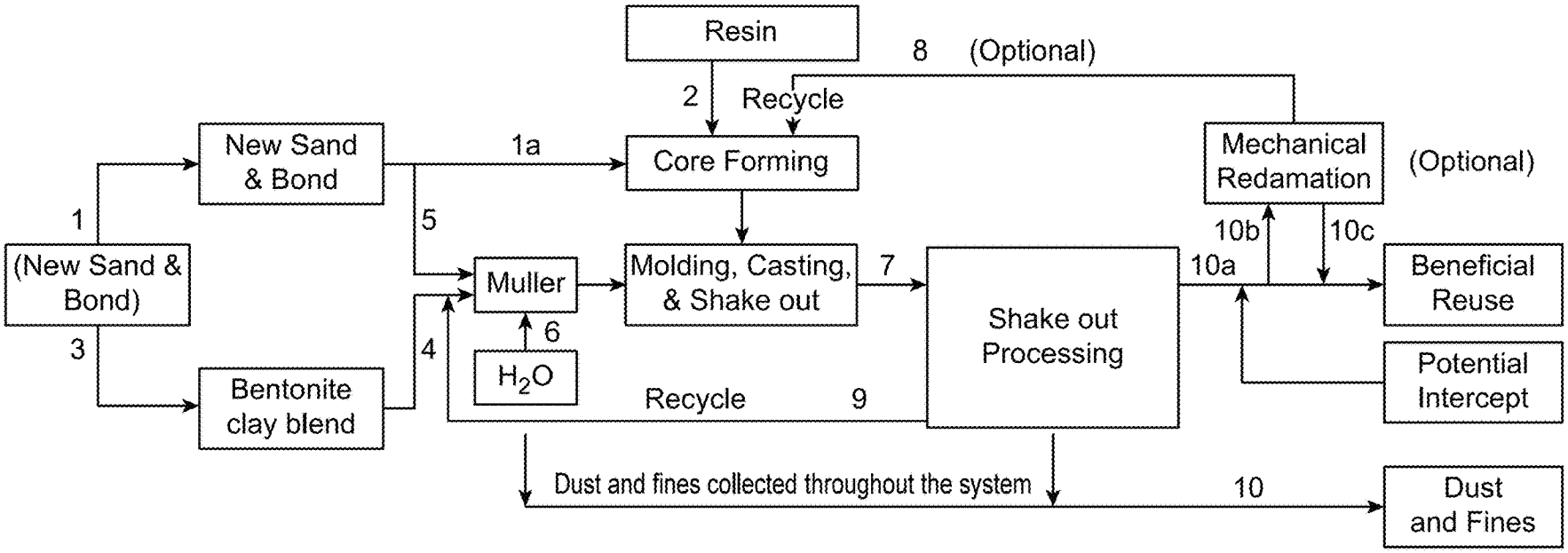
FIG. 1 depicts an exemplary foundry process for casting of metal parts.

The present invention includes processes for reclamation of sand and active clay from molding waste for use as raw materials for the foundry process.

During the casting step of a metal casting process, the mold material near the surface in contact with molten metal is exposed to high temperatures that thermally damages the sand and clay in this surface region. Sand is fractured and clay coating the sand is damaged to the extent it is "dead" or inactive and is thus rendered unusable for foundry processing. The dead clay refers to clay that is irreversibly dehydrated by thermal processing. As indicated above, a portion of the mold material after shake out is recycled to the muller. One hundred percent recycle of shake out material is not possible because the thermal damaged material would accumulate with time which would result in low quality or unusable molds.

Typically about 95% of the mold material is recycled to the muller. The approximately 5% of the mold material that is not recycled includes, in addition to damaged material, undamaged or otherwise usable active clay and sand. The active and dead clay are coated on the surface of the sand. The non-recycled material may be sent for waste disposal, used for some other beneficial purpose, and/or sent to a mechanical and thermal reclamation unit to recover sand which can be recycled to the core forming process. The mechanical and thermal reclamation process, however, destroys the clay.

A wide variety of thermal and mechanical reclamation systems are available for recovering sand. Examples include Simpson Technologies and Tinker-Omega. Many systems use a thermal decomposition followed by a mechanical scrubbing circuit or a mechanical/thermal/mechanical circuit. Emerging technologies use microwave technology. Sand reclamation may be more efficient with natural gas fueled drying and round grain sand morphology and less efficient with electrical driven drying and lake or angular sand.

A typical or conventional mechanical sand reclamation process may involve three stages: a first mechanical stage, a second thermal stage, and a third mechanical stage. The first stage may involve a mechanical scrubbing operation that blows ceramic beads to scrub clay and carbon from the sand particles. The second thermal stage may subject the scrubbed sand to high temperatures (e.g., about 600 deg C.) that thermally destroys the clay. The third mechanical stage removes the resulting dust from the sand.

As used herein with respect to the processes disclosed, the term "mechanical reclamation" may refer (e.g., Mechanical Reclamation in FIG. 1) generally to a sand reclamation process including, but not limited to mechanical processing, thermal processing, or both.

It is desirable to separate clay from sand in bag house and greensand systems, carbonaceous material from sand, and "active" clay from "dead" clay. Commercial systems include "homegrown" blackwater systems and Sonoperoxone® Blackwater Systems from Furness-Newburge. There are several research and development programs including Renotek, IMERYS, and others.

Some blackwater systems are successful, while others have had disastrous results with significant increases in scrap, defects, and maintenance costs. Only a handful of aqueous slurry bentonite reclamation systems are in operation and many units have been shut down.

There are a number of advantages of the present invention over commercial systems, which include, but are not limited to the following. Compared to commercial systems, the present invention does not use hydrogen peroxide or sonication and does not inject certain other chemicals. Additionally, commercial systems have high maintenance needs and the present invention has a reduced number of pumps and moving parts. Additionally, unlike commercial systems, the present embodiments are designed to account for the different chemical-physical properties of the clays. The commercial systems work best on a single type of clay, while the present invention may be designed for dual types of clays.

Embodiments of the present invention include processing the mold material or sand from the shake out process that is not recycled to separate the sand from clay without damage to the clay or otherwise maintaining the quality of the active clay so that it may be reused in a muller. During the processing, a slurry is formed from the sand and subsequent separation processes are performed in the form of a slurry. The slurry may be aqueous. Sand that is recovered may be recycled to the mechanical reclamation process in a foundry and fed to core forming. Alternatively, the recovered sand may be fed directly to core forming.

Clay slurry separated from the sand is subjected to processing in which the active clay is separated from the dead clay. The active clay slurry may then be recycled to the muller. Additionally, bag house dust may also be processing as described in the form of a slurry to separate active clay from the dust which can then be recycled to the muller.

The embodiments of the present invention have a number of advantages or benefits related to cost reduction, casting performance, mulling improvement, and energy reduction. Cost reduction may be achieved through recycling and purchase of less sand, recycling and purchase of less bentonite, recycling and purchase of less carbonaceous material, reduced emissions, less sand and clay material going to landfill or beneficial reuse, and recovery and recycling of metallic components in a waste stream. Cost is additionally reduced by reduced mulling energy due to the fact that the recovered active clay (minor portion of total clay used in muller) is in the form of a slurry (blackwater), and thus, is already hydrated. Cost is further reduced by reduced water usage in the muller (about the same total water usage overall) since the blackwater containing active clay is used as input to the muller and sand cooling systems.

The embodiments either improve casting performance or have no detrimental effect on casting finish. This may be due to the high quality of the recovered sand and active clay from the inventive processes. The embodiments Increase casting throughput due to reduction of mulling time and reduced casting surface defects.

As demonstrated by embodiments disclosed herein, mulling is improved in several ways including increased throughput due to prehydration of the portion of clay component. The mulling also has reduced energy consumption, lower viscosity of clay bond and easier mulling, and improved workability of clay and molding sand.

FIG. 1 depicts an exemplary foundry process for casting of metal parts. Sand output streams from shake out and dust output streams from this process may be used as input to reclamation processes of the present invention such as the exemplary processes shown in FIGS. 4-7. The reclaimed sand from these processes of FIGS. 4-7 may be used as input to the exemplary foundry process of FIG. 1, for example, to mechanical reclamation and then to core forming or directly to core forming. Reclaimed active clay, in the form of a blackwater stream from the processes of FIGS. 4-7 may be used as input to the exemplary foundry process of FIG. 1 in the muller. The feed to the Mechanical Reclamation is preferably less than 1% moisture, or more narrowly, 0.001 to 1% or 0.01 to 1% moisture. Therefore, this may make it preferable for or may necessitate installation of additional evaporator(s) or dryer(s).

As shown in FIG. 1, new sand and bonding material as stream 1 are mixed and fed to a core forming process as stream 1*a*. A resin in stream 2 is fed separately into the core forming process. A core is then formed from the new sand, bonding material, and resin.

New sand and bonding material as stream 3 are mixed with a bentonite clay blend which is typically a blend of active bentonite clay and additives including organics and carbon. An exemplary bentonite clay blend is Additrol® from AMCOL International Corporation of Hoffman Estates, Ill. Additrol® includes VOLCLAY® Natural Sodium Bentonite, activated Sodium Bentonite, blended Volclay® and activated sodium bentonite, seacoal, Flo-Carb®, and starch.

The sand and clay mixture is fed via stream 4 along with additional new sand from stream 5 to the muller to produce green sand molds. The green sand mold is made by press forming sand that is coated by a mixture of bentonite and additives. Fresh water from input stream 6 is fed to the muller which hydrates the bonding material and causes the grains of sand to adhere to one another which maintains the shape of the mold.

In the molding, casting, and shake out step, the core is inserted into the green sand mold and molten metal is poured into the green sand mold to produce a casting. After the molten metal solidifies, the casting undergoes a shake out. Shake out refers to breaking apart of the green sand mold and the core into small particles or clumps. During shake out, the particles of the core flow out of the solidified casting and become commingled with the particles from the green sand mold. During the casting process, a portion of the core and mold materials, including sand and clay, are thermally damaged and are rendered unusable.

The molding waste from the shake out is fed to optional further processing as stream 7 prior to being sent to recycle to muller, to waste disposal, to beneficial use, or to mechanical reclamation. The optional further processing may include, for example, cooling, breaking up the material, and separating out large chunks or particles. Exemplary shake out processes are shown in FIGS. 2 and 3.

A portion of shake out material or sand is recycled to the muller as stream 9. As indicated, this is typically about 95% of stream 7. The sand not recycled which is stream 10*a* may be sent to beneficial use. Optionally, a portion of stream 10*a* may be fed as stream 10*b* to a conventional Mechanical Reclamation process to reclaim sand from clay and recycled as stream 8 to core forming. Waste from the mechanical reclamation which includes destroyed clay is fed as stream 10*c* to beneficial use.

Finally, dust and fines (bag house dust) is collected as stream 10. The sand in stream 10*a* may have low total and low active clay, typical 3-7%. The bag house dust of stream 10 may have 37-67% total clay. In each case, the active clay may be less than 30-50% of the total clay.

Figure 2:
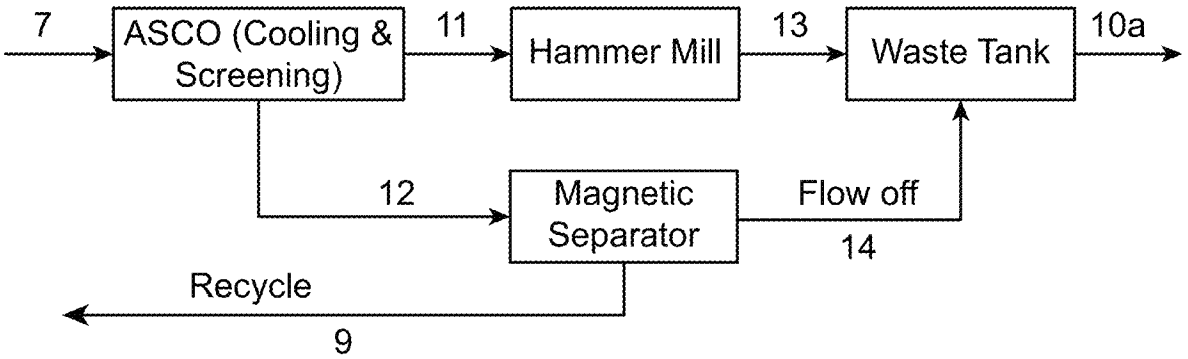
FIG. 2 depicts an exemplary shake out material process of FIG. 1.
Figure 3:
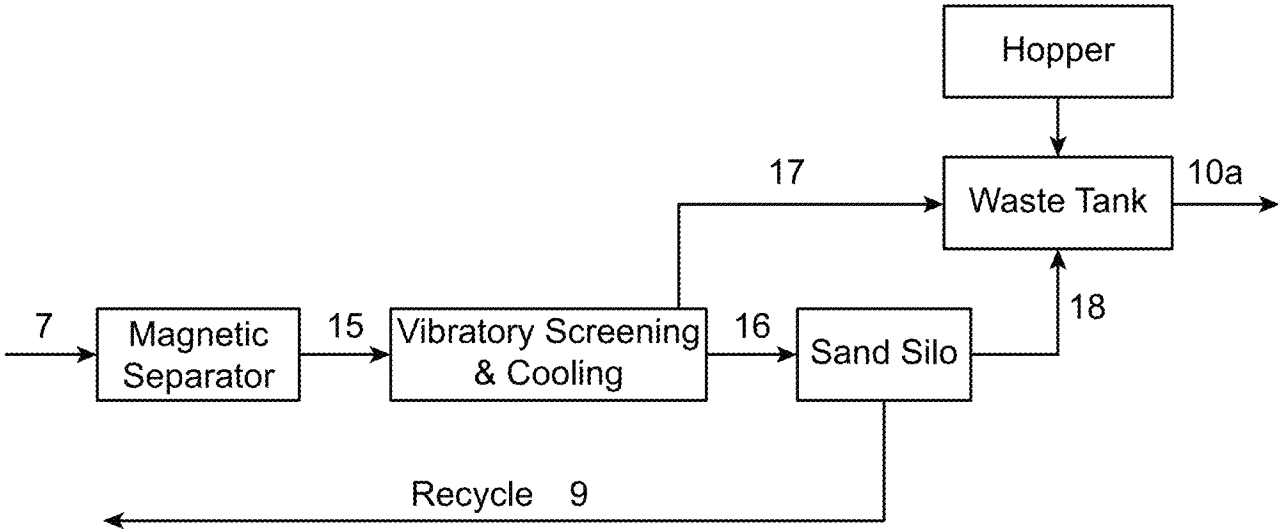
FIG. 3 depicts an exemplary shake out material process of FIG. 1.

FIG. 2 depicts an exemplary shake out material process of FIG. 1. Stream 7 from shake out is fed to separation unit where it is cooled and separated by screening to a stream 11 and a stream 12. The stream 11 is fed to a hammer mill which crushes the material into smaller pieces. The output from the hammer mill, stream 13, is fed to a waste tank. The stream 12 is fed into a magnetic separator which separates the stream to a stream 9 which is recycled as shown to the muller as a dry feed as shown in FIG. 1 and a stream 14 which is sent the waste tank. The material in the waste tank, stream 10*a*, is directed as shown in FIG. 1.

FIG. 3 depicts an exemplary shake out material process of FIG. 1. Stream 7 from shake out is fed to a magnetic separator to produce a stream 15. Stream 15 is fed to cooling and separating by vibratory screening into a stream 17 and a stream 16. The stream 16 is fed into a sand silo which further separates the stream into a stream 9 which is recycled to the muller, as shown in FIG. 1, and a stream 18 which is sent to the waste tank. Stream 17 is also sent to a waste tank. The material in the waste tank, stream 10*a*, is directed as shown in FIG. 1.

Embodiments of the present invention include reclamation processes comprising processing sand from the shake out process that is not recycled in conventional processes. The processing includes separating clay from the sand without thermal damage to the clay. The processing further includes separating clay from bag house dust from the foundry that is not recycled in conventional processes. The sand and/or dust fed into the processing have clay and carbon on the surface of dust and sand particles. The composition of clay of the dry feed may be 3 to 70%, 5 to 50%, 5 to 30%, 5 to 20%, 5 to 15%, or 5 to 10%.

The processing includes forming a slurry from the sand and/or dust and the separation of the clay form the sand/or dust is performed on the slurry. Sand may then be recovered from the slurry and recycled to the mechanical reclamation process and fed to core forming. Alternatively, the recovered sand may be fed directly to core forming. The clay separated from the sand and/or dust may be processed to separate active clay from the dead clay and active clay can be recycled to the muller.

The "Potential Intercept" in FIG. 1 indicates the point in the process where inventive reclamation processes may be integrated with the foundry process. The sand of stream 10*a* may be drawn off from the process at the Potential Intercept and fed into an inventive reclamation process. Dust from stream 10 may be drawn off and fed into the reclamation process. The dust, sand, or both are fed into the inventive reclamation process where a slurry is formed from the streams. In the reclamation processes, clay is separated from the input streams, without damage to the clay, to form clean sand and clay slurry streams.

The clean sand slurry stream may then be dried and fed back into the process of FIG. 1 at the Potential intercept and fed into Mechanical Reclamation and recycled as stream 8 or alternatively recycled directly as stream 8 without Mechanical Reclamation.

The dead, useable clay is separated as solids from the clay slurry stream to produce a clay slurry stream containing active clay in colloidal suspension. This clay slurry stream is referred to as blackwater. This blackwater stream may be recycled into the process of FIG. 1 into the muller. The blackwater stream may supplement or replace the fresh water stream 6 in FIG. 1.

Figure 4:
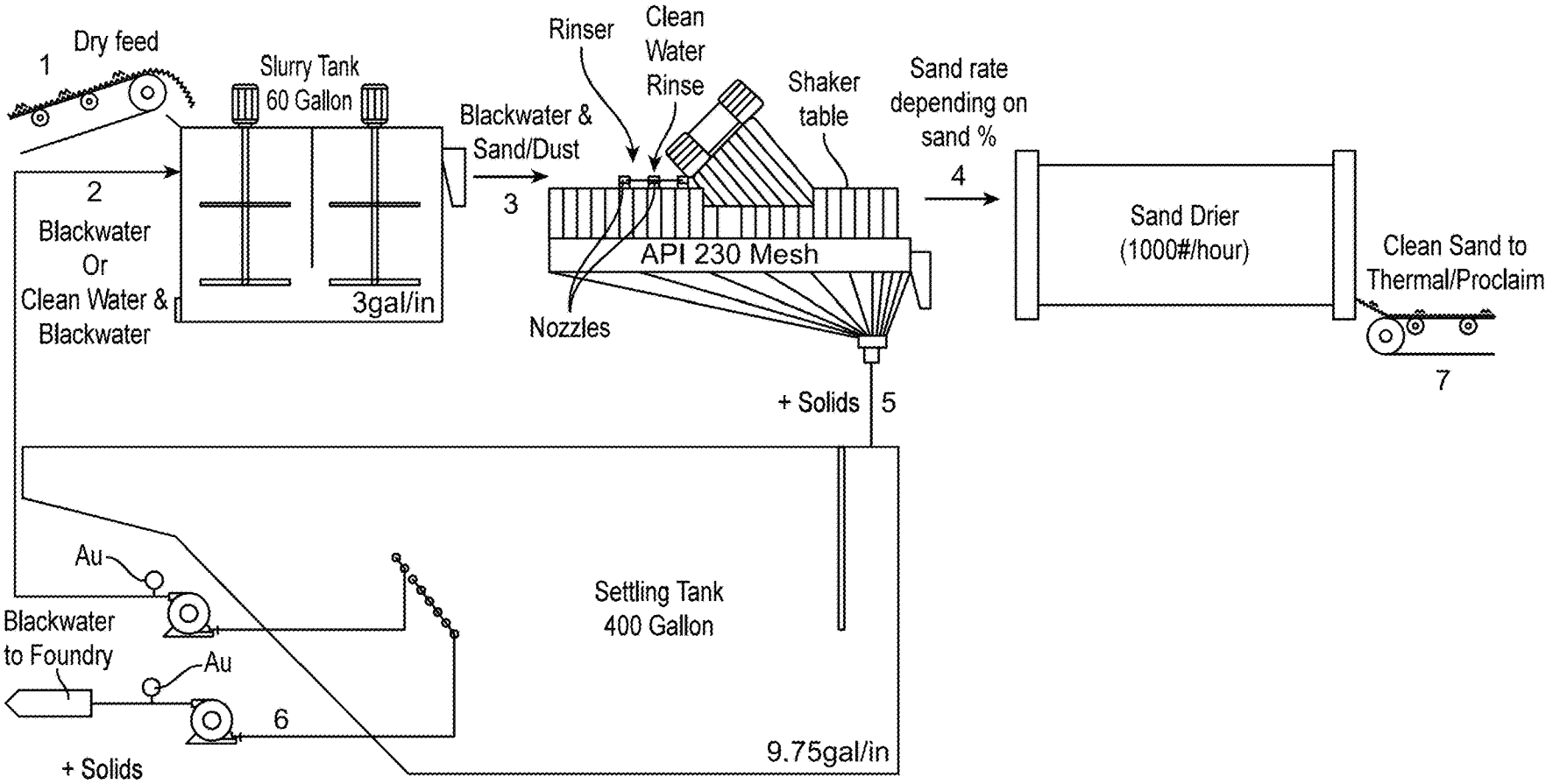
FIG. 4 depicts an exemplary reclamation process of the present invention.

FIG. 4 depicts an exemplary reclamation process of the present invention. The exemplary process includes a slurry tank, rinser/shaker unit, a settling tank, and a sand drier. A dry feed as stream 1 is fed into the slurry tank. The dry feed may be sand from stream 10*a* in FIG. 1, dust from stream 10 in FIG. 1, or both. Blackwater from the settling tank or blackwater and fresh water are fed into the slurry tank as stream 2. The water/blackwater and dry feed are mixed in the slurry tank. The slurry formed may have a solids concentration of 30 wt % or less, for example 5 to 30 wt %, 10 to 30 wt %, and 20 to 30 wt %. If the solids concentration is too high, a high viscosity slurry may result in making the slurry difficult to process. If the solids concentration is very low, e.g., less than 5 wt % or 1 wt %, the separation processing downstream is more difficult due to the high volume of slurry that must be processed.

The slurry exits the slurry tank as stream 3 into a rinser/shaker unit. The rinser/shaker has a rinser section and a shaker table with a mesh or screen platform. The rinser includes nozzles that can spray fresh water or blackwater. The spray from the nozzles removes clay and carbon from the surface of sand in the slurry. The clay and carbon separate as a slurry in stream 5 from the sand by flowing through the mesh into the settling tank. The slurry in the rinser may be rinsed at least one or one or more times with each rinse corresponding to one or more sets of nozzles, for example, 1 to 5 rinses, 2 to 5 rinses, 1, 2, 3, 4, 5, or more than 5 rinses. A rinse corresponds to spraying on water via a nozzle(s) to remove the clay component from the sand surface. Each rinse removes more clay and carbon from the sand which flows to the settling tank. After the rinse(s), the slurry flows to a shaker table which shakes or vibrates the slurry to remove more clay and carbon which flows through the mesh to the settling tank.

The slurry moves across the shaker table as the shaker table vibrates. When the slurry reaches the end of the shaker table, it is taken off as stream 4. Clay concentration in the sand in stream 4 may be less than 5%, less than 4%, less than 3%, less than 2%, less 1%, 0.5 to 2%, 1-2%, 1-3%, or 1-4%. Clay concentrations are based on the amount of clay compared to the amount of sand not including water. The concentration of clay corresponds to the amount left on the surface of the sand. Stream 4 may be fed to a sand drier which removes water to produce a clean sand stream 7 which may then be fed to Mechanical Reclamation or fed directly to core forming in FIG. 1.

The inventors have found (Table 10) that the clean sand of stream 7 of FIG. 4 may be the same or better quality as the sand stream 8 in FIG. 1 from Mechanical Reclamation. This may allow the foundry to lower temperatures of the thermal reclamation step of Mechanical Reclamation in order to reduce the pH increase associated with thermal treatment which may provide operational and resin binding savings.

The dead clay is separated from the active clay in the settling tank by settling out as solids in the tank. The active clay remains in a colloidal suspension. This colloidal solution of active clay is referred to as blackwater. The blackwater may be fed to the slurry tank as stream 2 and/or fed to the foundry at the muller as stream 6.

Referring to FIG. 4, in alternative embodiments, the dry feed can be fed directly to the rinser/shaker unit where it is hydrated for the first time by the rinser. Feeding the rinser/shaker with a slurry ("pre-slurry") is advantageous since retention time of the sand/dust is increased since the sand/dust is already hydrated before rinsing. The inventors have shown use of the pre-slurry as feed to the rinser/shaker results in more efficient removal of clay from the sand/dust in the rinser. Specifically, the amount of clay removed with each rinse is significantly higher with pre-slurry compared to no pre-slurry. (Tables 6 and 8)

Figure 5:
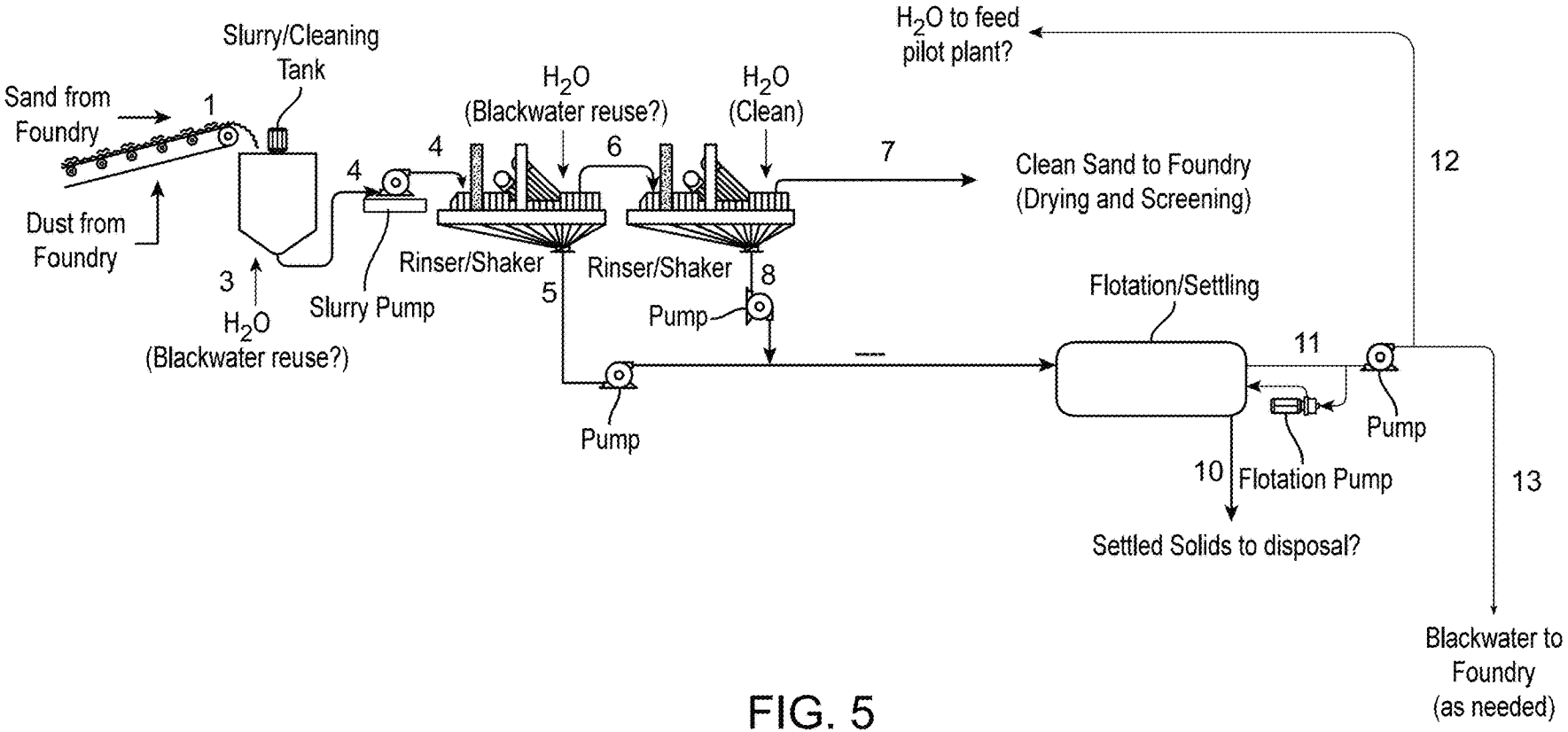
FIG. 5 depicts an exemplary reclamation process of the present invention.
Figure 6:
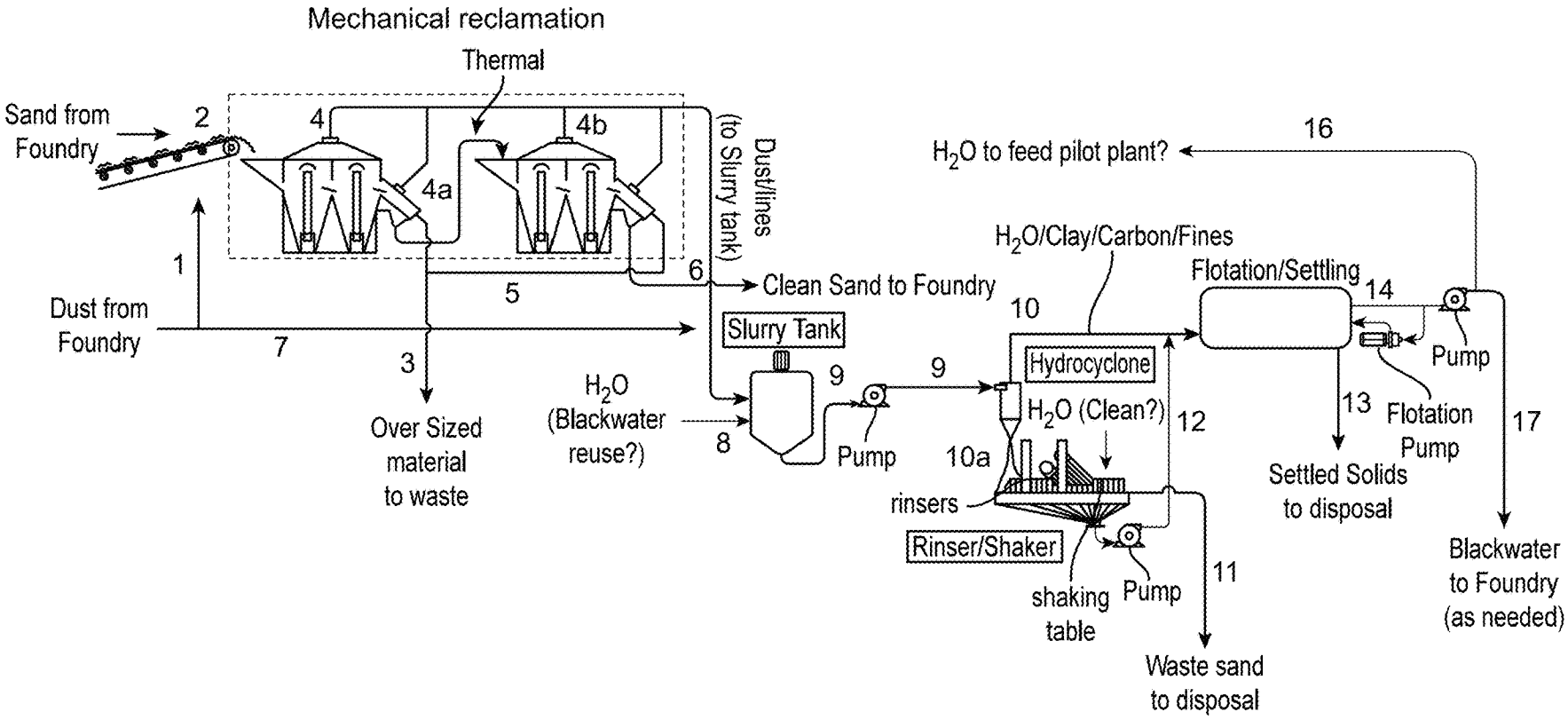
FIG. 6 depicts an exemplary reclamation process of the present invention.
Figure 7:
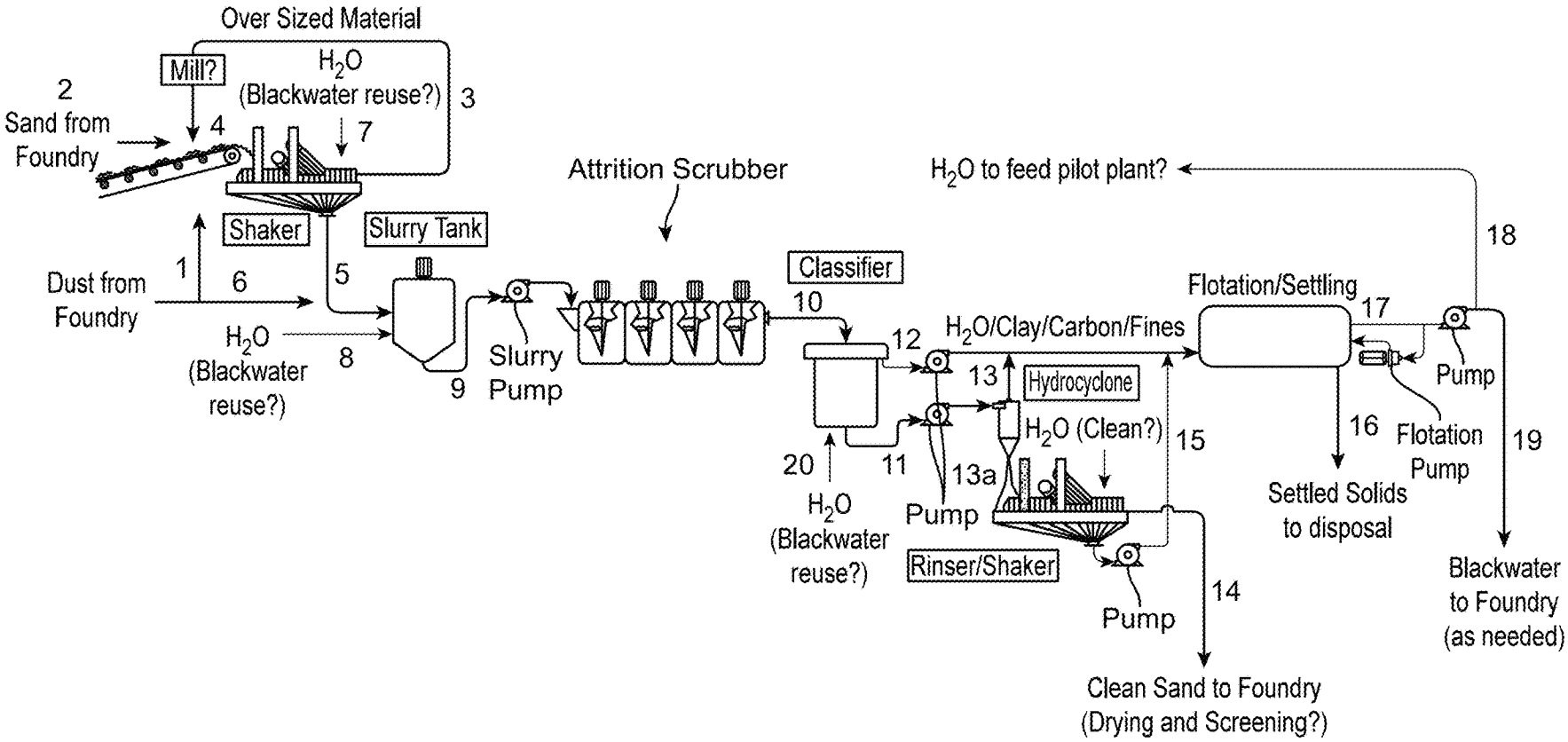
FIG. 7 depicts an exemplary reclamation process of the present invention.

Various additional embodiments are possible that employ separation using a slurry in a rinser/shaker and a settling tank as described above. FIGS. 5-7 depict examples of such additional embodiments.

FIG. 5 depicts an exemplary reclamation process of the present invention. The exemplary process includes a slurry tank, two rinser/shaker units, and a settling tank. A dry feed as stream 1 is fed into the slurry tank. The dry feed may be sand from stream 10*a* in FIG. 1, dust from stream 10 in FIG. 1, or both. Stream 1 is fed to a slurry tank along with water or water/blackwater to form a slurry.

The slurry from the slurry tank as stream 4 is pumped by a slurry pump to a two stage rinser/shaker process including two rinser/shaker units to separate clay from sand in the slurry stream 4. Alternatively, the process could include more than two stages.

Clay and carbon as stream 5 are separated in the first stage rinser/shaker unit from the sand in stream 4. Stream 5 is directed to the settling tank. Fresh water or water/blackwater may be used in the rinser of the first stage rinser/shaker unit. A slurry exits the shaker table of the first stage as stream 6 with sand including residual clay and carbon and is fed into the second stage rinser/shaker unit. Clay and carbon as stream 8 are separated in the second stage rinser/shaker unit from the sand in stream 6. Stream 8 is directed to the settling tank. Stream 7 that exits the shaker table of the second stage rinser/shaker unit may be fed to a sand drier which removes water to produce a clean sand stream which may then be fed to Mechanical Reclamation in FIG. 1 or fed directly to core forming in FIG. 1.

Streams 8 and 5 from the rinser/shaker units of FIG. 5 are fed into the flotation/settling tank and dead clay settles as solids and is removed as stream 10. The slurry stream 11 that includes active clay and carbon is recirculated by a flotation pump into the flotation/settling tank to allow further separation of solids. A water stream 12 from the slurry stream 11 may be fed to the foundry. Blackwater as stream 13 may be used as feed to the muller of the foundry as stream 6 in FIG. 1 and/or the slurry tank of FIG. 5.

FIG. 6 depicts an exemplary reclamation process of the present invention. The exemplary process employs a slurry to recover active clay. In this process, however, the slurry includes primarily or only dust and little or no sand. The dust feed to the slurry separation process is bag house dust stream 10 in FIG. 1 from the foundry, dust from the mechanical reclamation, such as from that shown in FIG. 1, or both. The sand feed to the mechanical reclamation unit of FIG. 8 may be stream 10*a* in FIG. 1. The exemplary process of FIG. 6 includes a mechanical reclamation process, a slurry tank, a rinser/shaker unit, and a settling tank.

A shown in FIG. 6, sand in stream 2 (stream 10*a* In FIG. 1) from the foundry and optionally dust from the foundry (stream 10 in FIG. 1) are fed into a mechanical reclamation unit to recover clean sand. Water or a combination of water and blackwater are fed into the slurry tank to form the slurry from dust from the mechanical reclamation unit. Dust in stream 7 from the foundry (stream 10 in FIG. 1) is fed directly to the slurry tank to form the slurry. Clean sand as stream 6 exits the mechanical reclamation unit and can be fed to the core forming process in FIG. 1.

The mechanical reclamation unit as shown includes two units for a two stage reclamation of sand. The first stage may be mechanical scrubbing and the second stage may be a thermal process. A stream 4*a* exits the first stage and is fed to the second stage. Dust as stream 4 exits the first stage and dust as stream 4*b* exits second stage and are fed to the slurry tank. An oversized material stream 3 exits the first stage and an oversized material stream 5 exits the second stage and both streams are sent to waste disposal.

Slurry from the slurry tank as stream 9 is pumped by a slurry pump to a rinser/shaker separator to separate clay and carbon from the dust in the slurry stream. The slurry stream 9 is optionally fed first to a hydrocyclone unit which removes water along with clay, carbon, and fines from stream 9 as stream 10 from the top of the unit which is fed to the flotation/settling tank. A slurry as stream 10*a* exits the bottom of the hydrocyclone and flows through the rinser/shaker.

Clay and carbon are separated in the rinser/shaker from the dust as stream 12 which is directed to the settling tank. Stream 11 that exits the shaker table is waste sent to disposal.

Streams 10 and 12 are fed into a flotation/settling tank and dead clay settles as solids and is removed as stream 13. The slurry stream 14 that includes active clay and carbon is recirculated by a flotation pump into the flotation/settling tank. A water stream 16 from the slurry stream may be fed to the foundry. Blackwater as stream 17 may be used in the foundry as stream 6 in FIG. 1 and/or as feed to the slurry tank as stream 8.

FIG. 7 depicts an exemplary reclamation process of the present invention. The exemplary process of FIG. 7 is similar to the embodiment of FIG. 4, however, optional additional processing steps are included. Sand from the foundry is initially optionally fed into a shaker and mill to reduce particle size. An attrition scrubber and classifier may be included between the slurry tank and a rinser/shaker. The attrition scrubber cleans the surface of the sand particles through particle-particle interactions. The classifier separates clay and carbon from the slurry with counter-flow of fluids. A settling tank is included after the rinser/shaker.

Dust in stream 1 of FIG. 7 from the foundry (stream 10 in FIG. 1) and sand in stream 2 of FIG. 7 from the foundry (stream 10*a* in FIG. 1) are fed into the shaker. A water stream 7 or combined water and blackwater stream is fed into the shaker table to hydrate the sand and dust during shaking. Smaller particles flow through the mesh as the hydrated sand and dust move across the shaker table and is removed as stream 5. The larger particles are taken off the end of the shaker table and recycled as stream 3. Before recycling, stream 3 is fed to a mill to reduce the particle size to produce stream 4 which is fed into the shaker. A dust stream from the foundry (stream 10, FIG. 1) is fed directly into a slurry tank along with stream 5 to form a slurry. A water stream or combined water and blackwater stream 8 is fed into the slurry tank.

Slurry as stream 9 from the slurry tank is pumped by a slurry pump to an attrition scrubber in which clay and carbon are cleaned off the surface of the particles. A slurry stream exits the attrition scrubber as stream 10 and is fed downward through the classifier. A water stream or combined water/blackwater stream 20 is fed through the bottom of the classifier upward through the classifier so that there is counter-flow of the slurry and water/blackwater stream. The classifier separates stream 10 into a stream 12 including clay, carbon, and fines and a stream 11. Stream 12 is pumped to a flotation/settler tank.

Stream 11 is pumped to a rinser/shaker. Clean sand is separated from clay in stream 11 in the rinser/shaker. The slurry stream 11 is optionally fed first to a hydrocyclone unit which removes water along with clay, carbon, and fines from stream 11 as stream 13 from the top of the unit which is fed to the flotation/settling tank. Slurry exits from the bottom of the hydrocyclone as stream 13*a* and flows through the rinser/shaker.

Additional clay and carbon are separated in the rinser/shaker from the sand as stream 15 which is directed to the settling tank. Stream 14 that exits the shaker table includes clean sand that is fed to the foundry after drying and screening at the Mechanical Reclamation or core forming of FIG. 1.

Dead clay settles as solids in the settling tank and is removed as stream 16 and is sent to waste disposal. The slurry stream 17 that includes active clay and carbon is recirculated by a flotation pump into the flotation/settling tank. A water stream 18 from the slurry stream may be fed to the foundry. Blackwater as stream 19 may be used in the foundry as stream 6 in FIG. 1 and/or the slurry tank of FIG. 7.

The reclaimed sand and clay from embodiments described and illustrated in FIG. 4-7 when used as foundry inputs have no negative impact on casting metrics.

The reclamation processes may be designed to meet all foundry safety and operational, electrical, and mechanical requirements.

The reclamation processes of FIGS. 4-7 may be sized for an output corresponding to the demands of the muller and cooling circuit water demand of the foundry.

Preferably, the reclamation units have zero total discharge, however, there may be residual sand fines and dead clay that will have to be disposed of. The processing units may have a small footprint and may be designed to be skid mounted units. Preferably, there will be zero water discharge achieved by conducting a water mass balance that matches water quantity used to reclaim clay to the water added to mullers or sand coolers. The aqueous blackwater reclamation units may be sized to the muller and sand cooling circuit water demand of the foundry. It may be desirable to have one pound of active bentonite per gallon of water fed back to mullers. The processing units may be designed to fit into an existing plant so there is a need to determine the targeted plant and stream flow rates. The design may minimize operational and maintenance issues.

Examples

The inventors have developed a blackwater technology for reclaiming sand, carbon, and active bentonite components. Numerous laboratory analyses have been conducted on over 100 bag house and system sands to determine % sand, % total clay, % active clay, % metallic, % carbon, and % resin in samples. Pilot plant testing on drum sized samples have been conducted to demonstrate separation of clay from sand, carbon from sand, and "active" clay from "dead" clay. Preparation is underway for metal casting studies to understand the impact of recycling blackwater containing active clay back to the muller on muller efficiency, greensand properties, casting performance, and casting finish.

Additional greensand and bag house dust sample analysis may be conducted to understand composition and variability. Mass and cost balances may be conducted to understand economic opportunity. Water balance may be conducted to understand water demand and correlation to blackwater generation.

In the Examples below, "Plant A" corresponds to FIGS. 1 and 2 which includes the optional Mechanical Reclamation and recycle to core forming and "Plant B" corresponds to FIGS. 1 and 3 without the optional Mechanical Reclamation and recycle.

Tables 1 to 4 show composition data of sand and dust-based samples that may be used as input to the reclamation processes shown in FIGS. 4-7.

Table 1 shows the composition of Plant A sand-based samples.

TABLE 1

Composition of Plant A Sand Based Samples

| Description | % Metallic Content | % Total Clay | % Active Clay | % Dead Clay | % Sand | % Resin | % Carbon | % Total |
|---|---|---|---|---|---|---|---|---|
| Plant A plow off sand | 1.0 | 11.6 | 5.8 | 5.8 | 83.9 | 1.3 | 2.2 | 100.0 |
| Plant A plow off sand | 1.1 | 13.1 | 6.7 | 6.4 | 81.7 | 1.4 | 2.7 | 100.0 |
| Plant A plow off sand | 0.2 | 12.8 | 6.2 | 6.6 | 83.1 | 1.3 | 2.6 | 100.0 |
| Plant A passed sand after 1st stage mechanical | 0.4 | 5.3 | 3.2 | 2.1 | 92.6 | 0.7 | 1.1 | 100.0 |
| Plant A 1st stage mechanical accepted sand going to thermal | 1.5 | 7.1 | 3.9 | 3.2 | 89.2 | 0.8 | 1.4 | 100.0 |
| Plant A passed sand after 1st stage mechanical | 3.0 | 2.6 | 1.2 | 1.4 | 93.0 | 0.6 | 0.8 | 100.0 |
| Plant A System Sand Plow off | 0.7 | 11.4 | 6.5 | 4.9 | 84.6 | 1.1 | 2.3 | 100.0 |
| Plant A System Sand Plow off | 0.7 | 13.3 | 8.6 | 4.7 | 82.4 | 1.2 | 2.4 | 100.0 |
| Plant A System Sand Plow off | 0.5 | 11.3 | 7.7 | 3.6 | 84.6 | 1.3 | 2.3 | 100.0 |
| Plant A Sand before 1st Stage Mechanical after Mag | 0.2 | 9.6 | 5.1 | 4.5 | 87.0 | 1.1 | 2.2 | 100.0 |
| 1st Stage Mechanical Accepted Sand | 0.2 | 2.0 | 1.7 | 0.3 | 96.9 | 0.3 | 0.6 | 100.0 |

TABLE 1-continued

| Composition of Plant A Sand Based Samples | | | | | | | | |
|---|---|---|---|---|---|---|---|---|
| Description | % Metallic Content | % Total Clay | % Active Clay | % Dead Clay | % Sand | % Resin | % Carbon | % Total |
| 1st Stage Mechanical Accepted Sand | 0.1 | 3.9 | 2.9 | 1.0 | 94.7 | 0.6 | 0.8 | 100.0 |
| 1st Stage Mechanical Accepted Sand | 0.2 | 6.1 | 6.5 | −0.4 | 91.4 | 0.9 | 1.4 | 100.0 |
| Finished Reclaim Sand | 0.1 | 0.5 | 0.2 | 0.3 | 99.2 | 0.03 | 0.2 | 100.0 |
| Sand from Plant A | 1.4 | 14.8 | 8.3 | 6.5 | 80.0 | 1.2 | 2.6 | 100.0 |
| Dust from Plant A | 17.9 | 28.3 | 10.8 | 17.5 | 45.3 | 3.3 | 5.2 | 100.0 |

Table 2 shows the composition of Plant B sand-based samples.

TABLE 2

| Composition of Plant B Sand Based Sample | | | | | | | | |
|---|---|---|---|---|---|---|---|---|
| Description | % Metallic Content | % Total Clay | % Active Clay | % Dead Clay | % Sand | % Resin | % Carbon | % Total |
| #1 - hopper #9 | 3.1 | 20.4 | 6.5 | 13.9 | 70.8 | 1.3 | 4.3 | 100.0 |
| #2 - hopper #9 | 3.7 | 16.8 | 6.0 | 10.8 | 74.1 | 1.4 | 4.0 | 100.0 |
| #3 - 22 belt 12/22 | 0.4 | 10.6 | 6.5 | 4.1 | 85.1 | 1.3 | 2.7 | 100.0 |
| #4 - 22 belt 12/22 7am | 0.8 | 10.7 | 6.9 | 3.8 | 84.8 | 1.1 | 2.6 | 100.0 |
| #5 - 22 belt 12/22 8am | 0.4 | 10.6 | 6.5 | 4.1 | 85.6 | 1.2 | 2.3 | 100.0 |
| #6 - mixer #9 12/22 | 9.7 | 26.9 | 8.3 | 18.6 | 56.2 | 1.3 | 5.9 | 100.0 |
| 30 Belt #1 | 0.5 | 11.0 | 6.9 | 4.1 | 85.0 | 1.1 | 2.4 | 100.0 |
| 30 Belt #2 | 0.7 | 10.0 | 6.9 | 3.1 | 85.8 | 1.1 | 2.4 | 100.0 |
| 30 Belt #3 | 0.6 | 10.6 | 6.9 | 3.7 | 85.3 | 1.1 | 2.4 | 100.0 |
| #9 Mixer #1 | 9.6 | 5.1 | 3.8 | 1.3 | 83.5 | 0.5 | 1.3 | 100.0 |
| #9 Mixer #1-1 | 5.5 | 6.3 | 3.1 | 3.2 | 85.8 | 0.8 | 1.6 | 100.0 |
| #9 Mixer #2 | 7.9 | 8.6 | 3.4 | 5.2 | 80.7 | 0.6 | 2.2 | 100.0 |
| #9 Mixer #3-1 | 8.4 | 4.6 | 3.8 | 0.8 | 85.4 | 0.4 | 1.2 | 100.0 |
| #9 Mixer #3-2 | 1.1 | 8.7 | 2.9 | 5.8 | 88.4 | 0.5 | 1.3 | 100.0 |
| Sand from Plant B | 0.5 | 9.4 | 6.9 | 2.5 | 86.6 | 1.3 | 2.1 | 100.0 |
| Dust from Plant B | 6.2 | 18.1 | 8.1 | 10.0 | 72.6 | 1.7 | 1.3 | 100.0 |

Table 3 shows the averages of compositions of dust-based samples from different sets of bag houses of a plant. The averages are derived from data in Tables 11-14. Specifically, the average for each column quantity for each set in a column are derived from the sample data in Tables 11-14: set 1 from Table 11, set 2 from Table 12, set 3 from Table 13, and set 4 from Table 14.

TABLE 3

| Composition of Plant Dust Based Samples from different sets of Bag houses of a plant - See Tables 11-14 | | | | | | | | | | | |
|---|---|---|---|---|---|---|---|---|---|---|---|
| Description | % Moisture | pH | AFS GFN | % Metallic Content | % Total Clay | % Active Clay | % Dead Clay | VCM % | LOI % | Carbon % | Sand % |
| Average for Set 1 | 2.6 | 8.8 | 132.4 | 6.8 | 67.5 | 27.3 | 40.2 | 11.5 | 21.9 | 16.5 | 9.3 |
| Average for Set 2 | 0.9 | 9.5 | 153.0 | 4.1 | 38.9 | 13.5 | 25.4 | 7.2 | 12.6 | 10.7 | 46.3 |
| Average for Set 3 | 1.6 | 9.4 | 129.8 | 1.1 | 37.3 | 18.3 | 18.9 | 6.3 | 16.3 | 12.8 | 48.9 |
| Average for Set 4 | 1.0 | 9.5 | 157.4 | 1.7 | 38.0 | 17.0 | 21.0 | 6.4 | 16.5 | 13.1 | 47.2 |
| Average | 1.5 | 9.3 | 143.2 | 3.4 | 45.4 | 19.0 | 26.4 | 7.9 | 16.8 | 13.3 | 37.9 |
| STDEV | 0.8 | 0.3 | 14.1 | 2.6 | 14.7 | 5.8 | 9.6 | 2.5 | 3.8 | 2.4 | 19.1 |
| min | 0.9 | 8.8 | 129.8 | 1.1 | 37.3 | 13.5 | 18.9 | 6.3 | 12.6 | 10.7 | 9.3 |
| max | 2.6 | 9.5 | 157.4 | 6.8 | 67.5 | 27.3 | 40.2 | 11.5 | 21.9 | 16.5 | 48.9 |
| coefficient of variation | 53.7 | 3.6 | 9.8 | 75.6 | 32.4 | 30.7 | 36.4 | 31.1 | 22.6 | 18.1 | 50.4 |

Table 4 shows composition of dust and sand-based samples from Plants A and B.

TABLE 4

Composition of dust and sand-based samples from Plants A and B

| Description | % Metallic Content | % Total Clay | % Active Clay | % Dead Clay | % Sand | % Resin | % Carbon | % Total |
|---|---|---|---|---|---|---|---|---|
| Sand from Plant A | 0.9 | 14.8 | 8.3 | 6.5 | 80.5 | 1.2 | 2.6 | 100.0 |
| Dust from Plant A | 17.9 | 28.3 | 10.8 | 17.5 | 45.3 | 3.3 | 5.2 | 100.0 |
| Dust from Plant B | 2.7 | 18.1 | 8.1 | 10.0 | 76.2 | 1.7 | 1.3 | 100.0 |
| Sand from Plant B | 0.5 | 9.4 | 6.9 | 2.5 | 86.6 | 1.3 | 2.1 | 100.0 |

Table 5 shows the composition of Plant A samples.

TABLE 5

Composition of Plant A samples

| Description | % Metallic Content | % Total Clay | % Active Clay | % Dead Clay | % Sand | % Resin | % Carbon | % Total |
|---|---|---|---|---|---|---|---|---|
| Sand from Plant A | 0.9 | 14.8 | 8.3 | 6.5 | 80.5 | 1.2 | 2.6 | 100.0 |
| Dust from Plant B | 17.9 | 28.3 | 10.8 | 17.5 | 45.3 | 3.3 | 5.2 | 100.0 |

Figure 8:
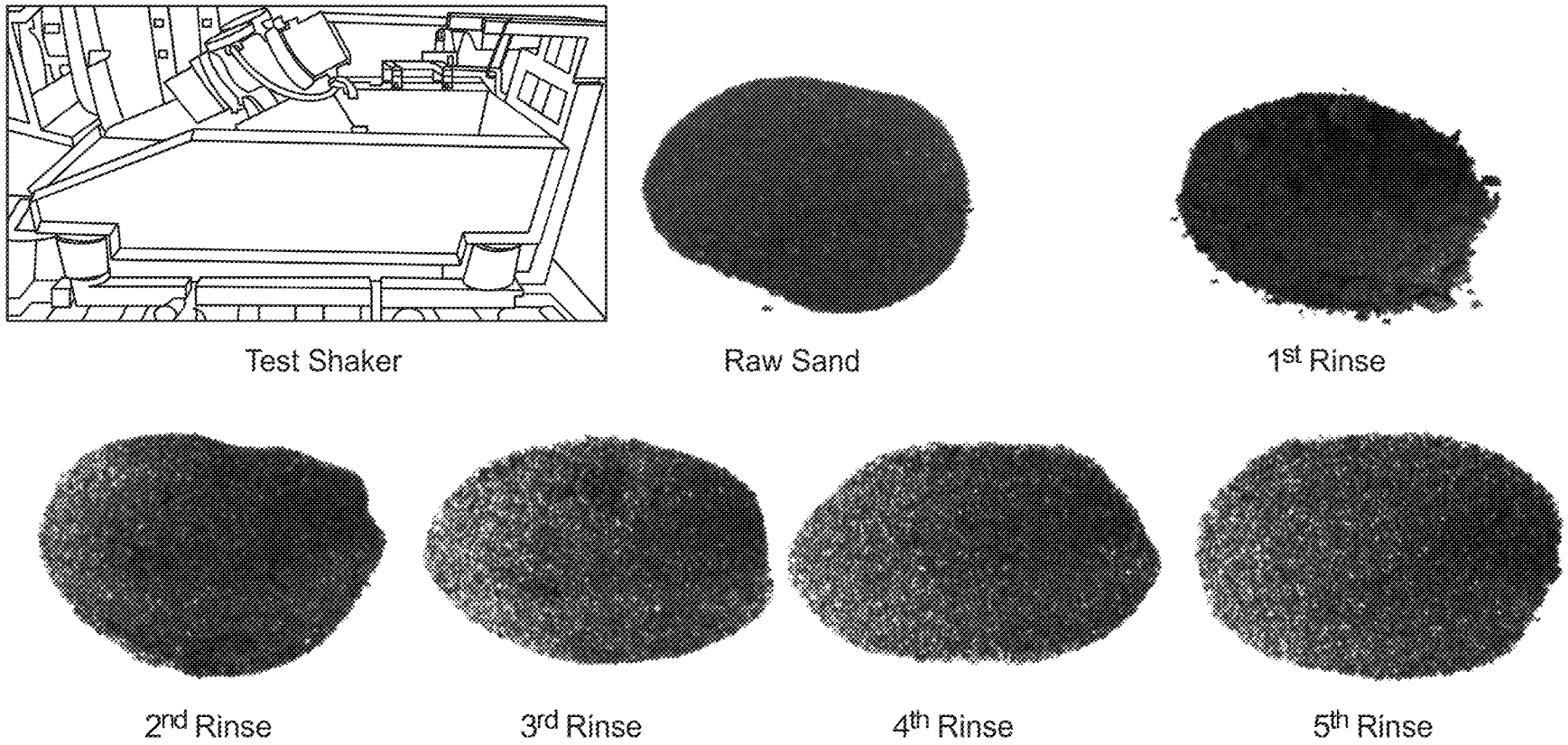
FIG. 8 depicts visual results of an evaluation of rinser/shaker tests on a Plant A sand stream with no pre-slurry.
Figure 9:
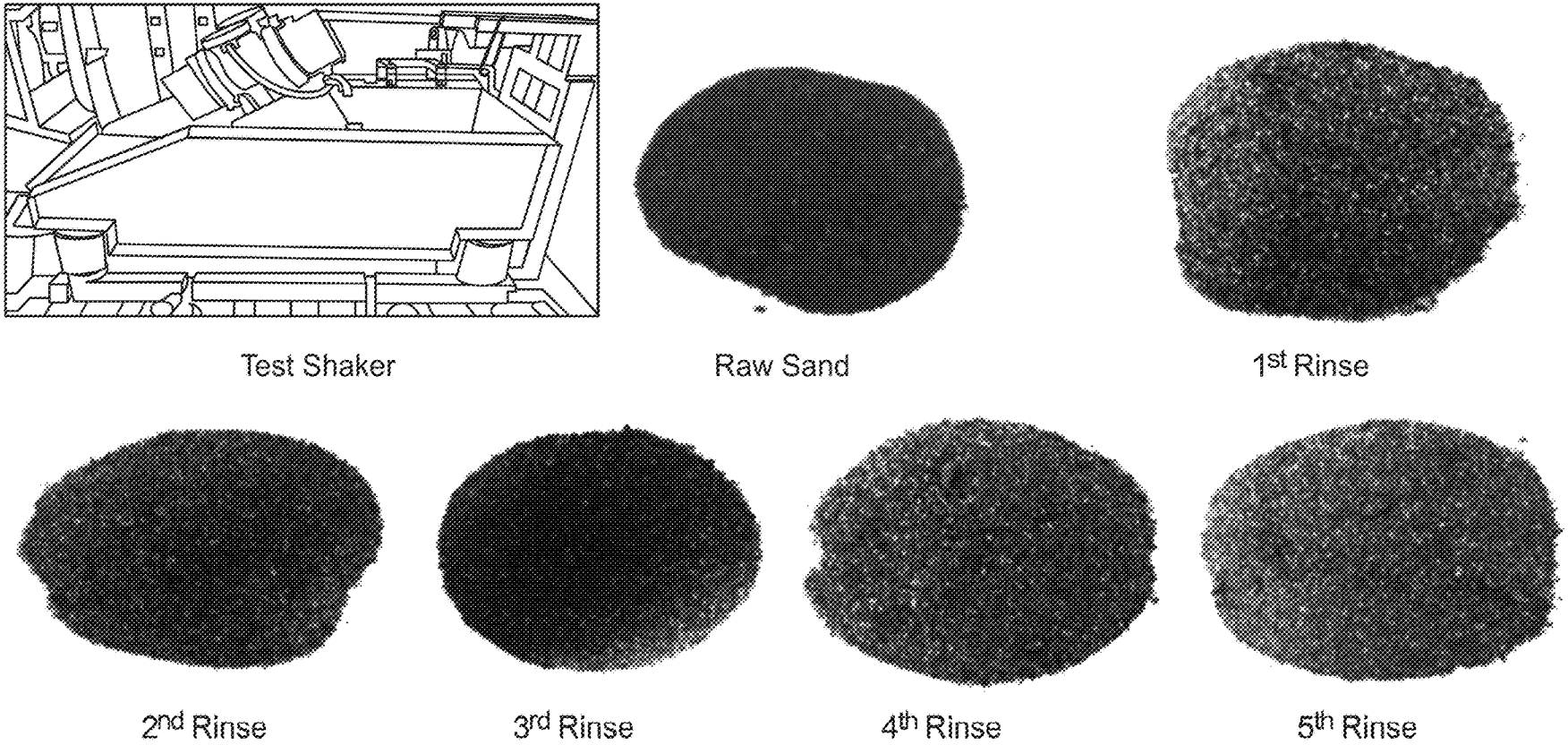
FIG. 9 depicts visual results of an evaluation of rinser/shaker tests on a Plant A sand stream using a pre-slurry.
Figure 10:
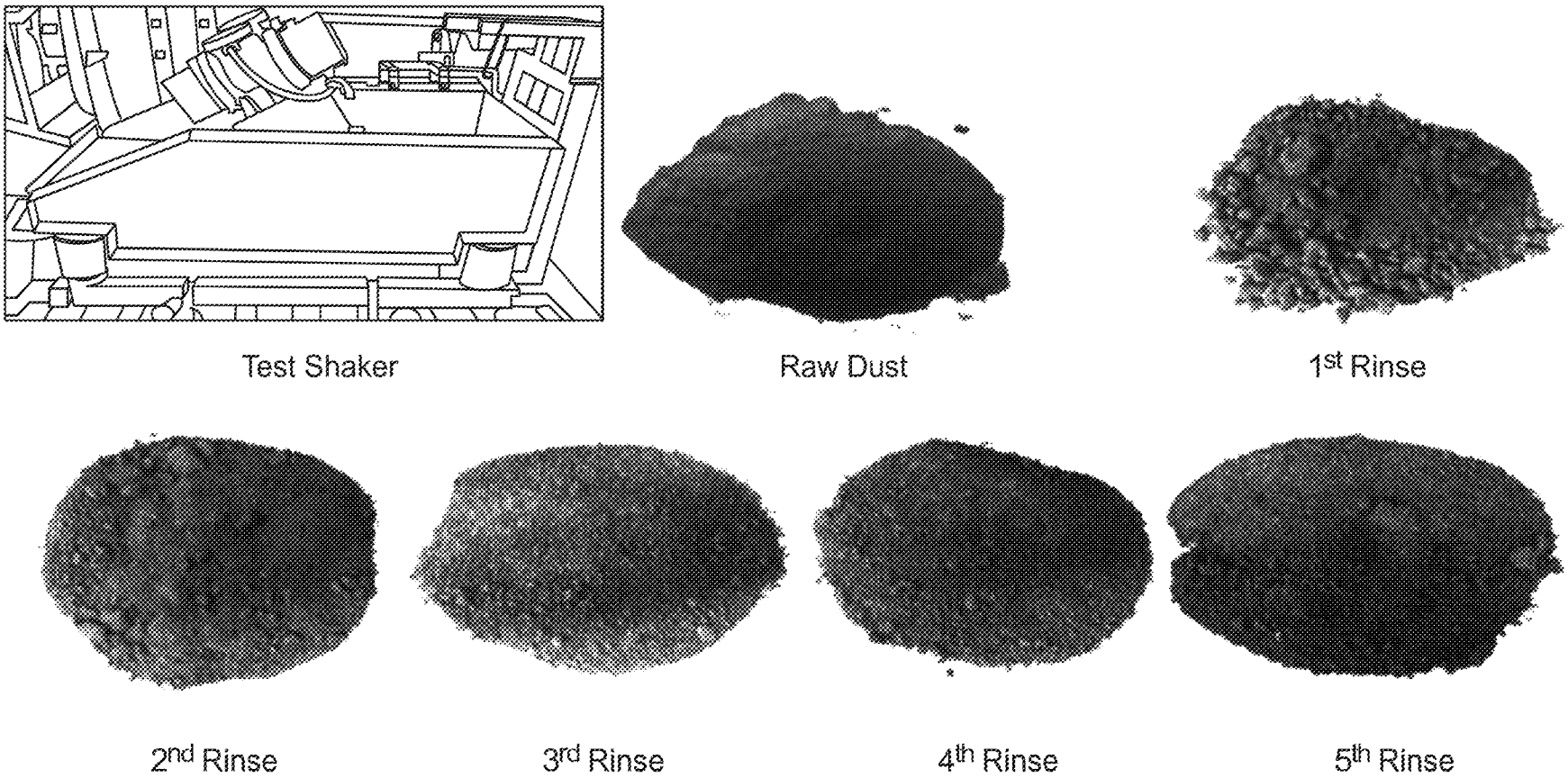
FIG. 10 depicts visual results of an evaluation of rinser/shaker tests on a Plant A dust stream with no pre-slurry.

Tables 6-10 and FIGS. 8-10 show the results of tests of rinser/shaker separation of clay from sand performed with sand and dust based samples shown in the tables above. Tests were performed with and without pre-slurry.

FIG. 8 depicts visual results of an evaluation of rinser/shaker tests on a Plant A sand stream with no pre-slurry. The feed to the rinser/shake table was dry sand feed. Raw sand was used as input to the rinser/shaker and samples were taken from the rinser/shaker and tested after the first, second, third, fourth, and fifth rinse. The raw sand is shown to be relatively fine. As the sand moves through each rinse, the clay and carbon are removed from the surface of the sand and the sand appears to become progressively coarser from the first to the fifth rinse.

FIG. 9 depicts visual results of an evaluation of rinser/shaker tests on a Plant A sand stream using a pre-slurry. The feed to the rinser/shaker table was a slurry of the sand that was 30% solids. As in the no pre-slurry case, as the sand moves through each rinse, the clay and carbon are removed from the surface of the sand and the sand appears to become progressively coarser from the first to the fifth rinse.

Table 6 shows analytical results from shaker table evaluation on Plant A sand stream with and without pre-slurry. A comparison of the Total Clay % from the raw sand to the fifth rinse shows that use of the pre-slurry is more efficient than not using pre-slurry. For example, for no the pre-slurry case the sand stream is 3.2% total clay after the fifth rinse while for the pre-slurry case the sand stream is 0.9% total clay after the fifth rinse, which demonstrates the higher efficiency of clay removal from the sand stream obtained by using the pre-slurry.

TABLE 6

Analytical Results from Shaker Table Evaluation on Plant A Sand Stream-with and without pre-slurry

| Description | % Moisture | pH | AFS GFN | % Metallic Content | % Total Clay | % Active Clay | % Dead Clay | VCM % | LOI % | Carbon % |
|---|---|---|---|---|---|---|---|---|---|---|
| Raw Sand No pre-slurry | 1.1 | 9.5 | — | 0.7 | 14.8 | 7.5 | 7.3 | 1.8 | 3.4 | 2.2 |
| Sand 1st Rinse | 14.7 | 9.6 | — | 0.5 | 3.2 | 2.1 | 1.1 | 1.3 | 2.0 | 1.6 |
| Sand 2nd Rinse | 17.3 | 9.3 | — | 0.4 | 1.1 | 0.3 | 0.8 | 1.1 | 1.5 | 1.3 |
| Sand 3rd Rinse | 13.9 | 9.2 | — | 0.5 | 0.6 | 0.5 | 0.1 | 1.1 | 1.4 | 1.0 |
| Sand 4th Rinse | 14.6 | 9.0 | — | 0.5 | 0.9 | 0.2 | 0.7 | 1.1 | 1.5 | 1.3 |
| Sand 5th Rinse | 15.0 | 9.1 | — | 0.5 | 0.9 | 0.3 | 0.6 | 1.1 | 1.3 | 1.0 |
| Sand was pre-slurried in water before processing on Shaker Table (30% Solids) | | | | | | | | | | |
| Raw Sand with preslurry | 1.1 | 9.5 | — | 0.7 | 14.8 | 7.5 | 7.3 | 1.8 | 3.4 | 2.2 |
| Waste Sand-Slurry - 1st rinse | 13.7 | 9.3 | — | 0.6 | 0.8 | 0.3 | 0.5 | 1.1 | 1.3 | 1.0 |
| Waste Sand-Slurry - 2st rinse | 14.2 | 9.0 | — | 0.7 | 1.2 | 0.3 | 0.9 | 1.1 | 1.3 | 1.4 |

TABLE 6-continued

| Analytical Results from Shaker Table Evaluation on Plant A Sand Stream-with and without pre-slurry | | | | | | | | | | |
|---|---|---|---|---|---|---|---|---|---|---|
| Description | % Moisture | pH | AFS GFN | % Metallic Content | % Total Clay | % Active Clay | % Dead Clay | VCM % | LOI % | Carbon % |
| Waste Sand-Slurry - 3rd rinse | 14.0 | 8.7 | — | 0.8 | 0.6 | 0.3 | 0.3 | 1.2 | 1.3 | 1.2 |
| Waste Sand-Slurry - 4th rinse | 15.4 | 8.7 | — | 0.3 | 1.5 | 0.3 | 0.8 | 1.1 | 1.2 | 0.9 |
| Waste Sand-Slurry - 5th rinse | 14.6 | 8.6 | — | 0.4 | 3.2 | 0.3 | 2.5 | 1.1 | 1.3 | 0.9 |

Table 7 shows analytical results from blackwater effluent from rinser/shaker table evaluation on Plant A sand stream with pre-slurry.

TABLE 7

| Analytical Results from Blackwater Effluent from Shaker Table Evaluation on Plant A Sand Stream - with pre-slurry | | | | | |
|---|---|---|---|---|---|
| Description | % Solids | % Active Clay | VCM % | LOI % | Carbon % |
| Plant A Waste Sand - Slurry Blackwater sample | 5.1 | 49.7 | 11.1 | 20.6 | 11.9 |

FIG. 10 depicts visual results of an evaluation of rinser/shaker tests on a Plant A dust stream with no pre-slurry. The feed to the rinser/shake table was dry dust feed. Raw dust was used as input to the rinser/shaker and samples were taken and tested after the first, second, third, fourth, and fifth rinse. The raw dust is shown to be relatively fine. However, clumps of dust are apparent after the first rinse and the clumps become smaller after the second rinse. These images that show the clumping suggest the removal of clay is not efficient. The clumps become less apparent after the third, fourth, and fifth rinses.

Figure 11:
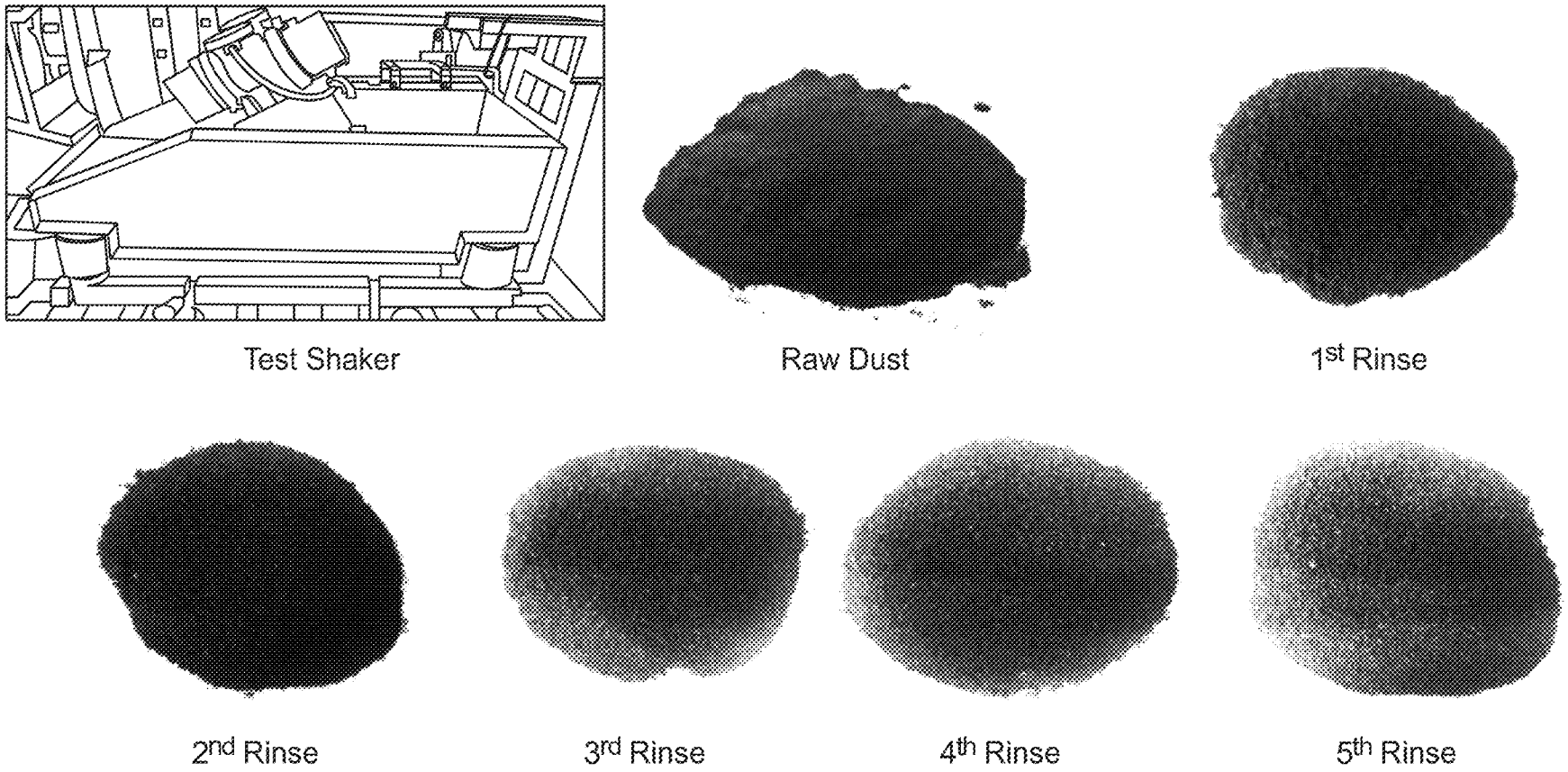
FIG. 11 depicts visual results of an evaluation of rinser/shaker tests on a Plant A dust stream using a pre-slurry.

FIG. 11 depicts visual results of an evaluation of rinser/shaker tests on a Plant A dust stream using a pre-slurry. The feed to the rinser/shaker table was a slurry of the dust that was 30% solids. Unlike the no pre-slurry case, there is no clumping and as the dust moves through each rinse, the clay and carbon are removed from the surface of the dust and the dust appears to become progressively coarser from the first to the fifth rinse. The absence of clumping and progressive increase in coarseness suggests the pre-slurry provides a more efficient removal of clay than no slurry.

Table 8 shows analytical results from the rinser/shaker table evaluation on Plant A dust stream with and without pre-slurry. A comparison of the Total Clay % from the raw dust to the fifth rinse shows that use of the pre-slurry confirms that the use of the pre-slurry is significantly more efficient than with no pre-slurry and that the use of a pre-slurry is preferable and likely necessary. For example, for no the pre-slurry case the dust stream is 3.2% total clay after the fifth rinse while for the pre-slurry case the dust stream is 1% total clay after the fifth rinse, which demonstrates the higher efficiency of clay removal from the dust stream obtained by using the pre-slurry.

TABLE 8

| Analytical Results from Shaker Table Evaluation on Plant A Dust Stream-with and without pre-slurry | | | | | | | | | | |
|---|---|---|---|---|---|---|---|---|---|---|
| Description | % Moisture | pH | AFS GFN | % Metallic Content | % Total Clay | % Active Clay | % Dead Clay | VCM % | LOI % | Carbon % |
| Raw Dust No pre-slurry | 1.2 | 10.1 | 130.4 | 43 | 28.3 | 10.8 | 17.5 | 3.3 | 4.6 | 2.6 |
| Waste Dust 1st rinse | 20.0 | 8.9 | — | 11.8 | 17.5 | 5.1 | 12.4 | 1.7 | 4.9 | 5.4 |
| Waste Dust 2st rinse | 19.1 | 8.9 | — | 16.8 | 6.2 | 2.4 | 3.8 | 1.0 | 2.3 | 4.3 |
| Waste Dust 3rd rinse | 20.2 | 8.7 | — | 16.8 | 2.2 | 0.7 | 1.5 | 0.7 | 1.0 | 3.9 |
| Waste Dust 4th rinse | 20.4 | 8.7 | — | 17.8 | 1.5 | 0.7 | 0.8 | 0.7 | 1.6 | 4.0 |
| Waste Dust 5th rinse | 18.8 | 8.8 | — | 14.3 | 3.2 | 0.7 | 2.5 | 1.3 | 3.6 | 4.6 |
| Sand was pre-slurried in water before processing on Shaker Table (30% Solids) | | | | | | | | | | |
| Raw Dust No pre-slurry | 1.2 | 10.1 | 130.4 | 43 | 28.3 | 10.8 | 17.5 | 3.3 | 4.6 | 2.6 |
| Waste Dust- Slurry 1st rinse | 15.4 | 8.7 | — | 18.2 | 1.2 | 0.3 | 1.2 | 0.2 | 1.7 | 1.1 |
| Waste Dust- Slurry 2nd rinse | 17.6 | 8.8 | — | 14.4 | 1.1 | 0.7 | 1.1 | 0.7 | 1.8 | 3.1 |
| Waste Dust- Slurry 3rd rinse | 16.1 | 9.0 | — | 15.1 | 1.1 | 0.3 | 1.1 | 0.4 | 0.3 | 2.6 |
| Waste Dust- Slurry 4th rinse | 17.1 | 8.8 | — | 10.6 | 1.1 | 0.3 | 1.1 | 1.1 | 2.7 | 3.4 |
| Waste Dust- Slurry 5th rinse | 17.0 | 8.9 | — | 12.0 | 1.0 | 0.3 | 1.0 | 0.8 | 0.9 | 2.5 |

Table 9 shows composition of samples from the rinser/shaker table of Plant A waste dust blackwater. Table 9 shows that the Blackwater produced consisted of 13.7% solids/86.3% water and that the solids contained 19.9% active clay and 11.9% carbon. The solids provide a measurement of 8% VCM (Volatile Carboanceous Material) and 16.5% loss on ignition.

TABLE 9

Composition of Samples from Shaker Table Plant A Waste Dust Blackwater

| Description | % Solids | % Active Clay | VCM % | LOI % | Carbon % |
|---|---|---|---|---|---|
| Blackwater Sample | 13.7 | 19.9 | 8.5 | 16.5 | 11.9 |

Table 10 shows analytical results of sand effluent from shaker table evaluation on Plant A sand stream with and without 30% solids pre-slurry. The first three rows show the pH and acid demand values (ADV) of sand In the Plant A process: before first stage Mechanical Reclamation (stream 10*b*, FIG. 1); after the first stage Mechanical Reclamation; and the reclaimed sand (stream 8, FIG. 1). The last five rows show the pH and ADV of raw sand into the shaker table and after the first and second rinse for both no pre-slurry and with pre-slurry. Since a low value of pH and ADV is preferable, the data shows that the clean sand resulting from the shaker tables is as good as the sand effluent from the Mechanical Reclamation. The use of clean sand from the shaker tables as input to Mechanical Reclamation may allow a lower temperature in the Mechanical Reclamation in order to reduce the pH increase associated with thermal treatment. This may also lead to operational and resin binding savings.

TABLE 10

Analytical Results of Sand Effluent from Shaker Table Evaluation on Plant A Sand Stream - with and without 30% solids pre-slurry

| Sample | pH | ADV @ pH 3 | ADV @ pH 4 | ADV @ pH 5 | LOI |
|---|---|---|---|---|---|
| Plant A Sand before 1st Stage Mechanical reclamation (stream 10b, FIG. 1) | 10.1 | 47.0 | 43.0 | 37.0 | 2.8 |
| After 1st stage Mechanical Reclamation (FIG. 1) | 10.1 | 36.6 | 33.0 | 28.0 | 2.1 |
| Finished Reclaimed Sand (stream 8, FIG. 1) | 10.4 | 11.6 | 9.7 | 8.2 | 0.2 |
| Analytical Results from Shaker Table Experiments | | | | | |
| Plant A Raw Sand | 9.5 | 52.6 | 47.0 | 41.2 | 3.4 |
| Plant A Sand - no Slurry 1st Rinse | 9.6 | 26.1 | 23.7 | 20.6 | 2.0 |
| Plant A Sand 2nd Rinse | 9.3 | 26.0 | 24.3 | 24.0 | 1.5 |
| Plant A Waste Sand - Slurry - 1st rinse | 9.3 | 17.0 | 15.9 | 14.3 | 1.3 |
| Plant A Waste Sand - Slurry 2st rinse | 9.0 | 14.2 | 12.8 | 12.0 | 1.3 |

Table 11 shows sample data for a set 1 of bag house dust samples from mold cooling lines of a plant used to calculate average composition of dust based samples shown in Table 3.

TABLE 11

Set 1 bag house dust samples from Mold Cooling Lines of a plant - see Table 3

| Description | % Moisture | pH | AFS GFN | % Metallic Content | % Total Clay | % Active Clay | % Dead Clay | VCM % | LOI % | Carbon % | Sand % |
|---|---|---|---|---|---|---|---|---|---|---|---|
| Samples 1 | 3.2 | 8.6 | 175.8 | 5.0 | 68.8 | 26.6 | 42.2 | 10.1 | 20.8 | 16.2 | 10.0 |
| Samples 2 | 2.4 | 8.7 | 125.2 | 5.2 | 76.5 | 27.4 | 49.1 | 13.9 | 23.6 | 17.6 | 0.7 |
| Samples 3 | 2.4 | 9.0 | 131.4 | 6.2 | 69.8 | 26.6 | 43.2 | 11.1 | 21.6 | 16.0 | 8.0 |
| Samples 4 | 2.5 | 8.8 | 76.4 | 6.4 | 65.1 | 29.1 | 36.0 | 12.0 | 22.8 | 16.8 | 11.7 |
| Samples 5 | 2.7 | 8.9 | 153.2 | 11.0 | 57.2 | 26.6 | 30.6 | 10.5 | 20.6 | 15.9 | 15.9 |
| Average | 2.6 | 8.8 | 132.4 | 6.8 | 67.5 | 27.3 | 40.2 | 11.5 | 21.9 | 16.5 | 9.3 |
| Standard Deviation (STDEV) | 0.3 | 0.2 | 37.1 | 2.5 | 7.1 | 1.1 | 7.1 | 1.5 | 1.3 | 0.7 | 5.6 |
| Min | 2.4 | 8.6 | 76.4 | 5.0 | 57.2 | 26.6 | 30.6 | 10.1 | 20.6 | 15.9 | 0.7 |
| Max | 3.2 | 9.0 | 175.8 | 11.0 | 76.5 | 29.1 | 49.1 | 13.9 | 23.6 | 17.6 | 15.9 |
| Coefficient of Variation (CV) | 12.0 | 1.8 | 28.0 | 36.4 | 10.5 | 4.0 | 17.7 | 12.9 | 5.9 | 4.3 | 60.4 |

Due to high clay carryover when testing for metallic, the metallic were tested on the sample after AFS Clay wash and then expressed as a percentage of the overall sample % Sand is calculated by difference: (% Sand = (100%) − (% Total Clay) − (% Metallic) − (% Carbon)

Table 12 shows sample data for a set 2 of bag house dust samples from return sand belts of a plant used to calculate average composition of dust based samples shown in Table 3.

TABLE 12

Set 2 baghouse dust samples from return sand belts of a plant - see Table 3

| Description | % Moisture | pH | AFS GFN | % Metallic Content | % Total Clay | % Active Clay | % Dead Clay | VCM % | LOI % | Carbon % | Sand % |
|---|---|---|---|---|---|---|---|---|---|---|---|
| Samples 1 | 0.4 | 9.6 | 105.7 | 7.6 | 18.5 | 6.0 | 12.5 | 5.2 | 5.2 | 5.6 | 68.3 |
| Samples 2 | 1.1 | 9.5 | 169.6 | 3.4 | 61.8 | 15.4 | 46.4 | 7.9 | 14.7 | 12.0 | 22.8 |
| Samples 3 | 1.1 | 9.5 | 175.5 | 3.8 | 42.5 | 16.3 | 26.2 | 8.4 | 16.3 | 13.5 | 40.2 |
| Samples 4 | 1.0 | 9.5 | 188.6 | 1.9 | 48.8 | 18.0 | 30.8 | 8.9 | 17.2 | 13.6 | 35.7 |
| Samples 5 | 0.7 | 9.4 | 125.5 | 3.9 | 23.0 | 12.0 | 11.0 | 5.8 | 9.8 | 8.9 | 64.2 |

TABLE 12-continued

| Set 2 baghouse dust samples from return sand belts of a plant - see Table 3 | | | | | | | | | | | |
|---|---|---|---|---|---|---|---|---|---|---|---|
| Description | % Moisture | pH | AFS GFN | % Metallic Content | % Total Clay | % Active Clay | % Dead Clay | VCM % | LOI % | Carbon % | Sand % |
| Average | 0.9 | 9.5 | 153.0 | 4.1 | 38.9 | 13.5 | 25.4 | 7.2 | 12.6 | 10.7 | 46.3 |
| Standard Deviation (STDEV) | 0.3 | 0.1 | 35.5 | 2.1 | 18.1 | 4.7 | 14.5 | 1.6 | 5.1 | 3.4 | 19.4 |
| Min | 0.4 | 9.4 | 105.7 | 1.9 | 18.5 | 6.0 | 11.0 | 5.2 | 5.2 | 5.6 | 22.8 |
| Max | 1.1 | 9.6 | 188.6 | 7.6 | 61.8 | 18.0 | 46.4 | 8.9 | 17.2 | 13.6 | 68.3 |
| Coefficient of Variation (CV) | 38.6 | 1.0 | 23.2 | 50.7 | 46.4 | 35.1 | 57.3 | 22.6 | 40.0 | 32.1 | 42.0 |

Table 13 shows sample data for a set 3 of baghouse dust samples from gate & sprue conveyor, return sand elevator, sand return sand belts of a plant used to calculate average composition of dust based samples shown in shown in see Table 3.

TABLE 13

| Set 3 baghouse dust samples from Gate & Sprue Conveyor, Return Sand Elevator, Sand Return Sand Belts of a plant - see Table 3 | | | | | | | | | | | |
|---|---|---|---|---|---|---|---|---|---|---|---|
| Description | % Moisture | pH | AFS GFN | % Metallic Content | % Total Clay | % Active Clay | % Dead Clay | VCM % | LOI % | Carbon % | Sand % |
| Samples 1 | 1.8 | 9.3 | 150.6 | 1.4 | 45.4 | 19.7 | 25.7 | 6.5 | 15.5 | 12.1 | 41.1 |
| Samples 2 | 1.6 | 9.4 | 128.2 | 0.9 | 38.1 | 18.0 | 20.1 | 6.0 | 15.8 | 11.9 | 49.1 |
| Samples 3 | 1.7 | 9.4 | 127.2 | 1.0 | 36.1 | 18.0 | 18.1 | 6.7 | 17.8 | 14.0 | 48.9 |
| Samples 4 | 1.1 | 9.4 | 114.9 | 1.2 | 29.9 | 16.3 | 13.6 | 5.9 | 14.9 | 11.9 | 57.0 |
| Samples 5 | 1.9 | 9.6 | 128.2 | 0.9 | 36.8 | 19.7 | 17.1 | 6.6 | 17.6 | 14.1 | 48.2 |
| Average | 1.6 | 9.4 | 129.8 | 1.1 | 37.3 | 18.3 | 18.9 | 6.3 | 16.3 | 12.8 | 48.9 |
| Standard Deviation (STDEV) | 0.3 | 0.1 | 12.9 | 0.2 | 5.5 | 1.4 | 4.5 | 0.3 | 1.3 | 1.1 | 5.6 |
| Min | 1.1 | 9.3 | 114.9 | 0.9 | 29.9 | 16.3 | 13.6 | 5.9 | 14.9 | 11.9 | 41.1 |
| Max | 1.9 | 9.6 | 150.6 | 1.4 | 45.4 | 19.7 | 25.7 | 6.7 | 17.8 | 14.1 | 57.0 |
| Coefficient of Variation (CV) | 18.3 | 1.1 | 9.9 | 19.2 | 14.9 | 7.8 | 23.6 | 5.4 | 7.9 | 8.9 | 11.6 |

Table 14 shows a Set 4 sample data for baghouse dust samples from gate & sprue conveyors, mold cooling, return sand belts, mag drum of a plant used to calculate average composition of dust based samples shown in shown in Table 3.

TABLE 14

| Set 4 bag house dust samples from Gate & Sprue Conveyors, Mold Cooling, Return Sand Belts, Mag Drum of a plant - see Table 3 | | | | | | | | | | | |
|---|---|---|---|---|---|---|---|---|---|---|---|
| Description | % Moisture | pH | AFS GFN | % Metallic Content | % Total Clay | % Active Clay | % Dead Clay | VCM % | LOI % | Carbon % | Sand % |
| Samples 1 | 1.2 | 9.4 | 190.2 | 2.2 | 47.3 | 21.4 | 25.9 | 7.2 | 19.8 | 15.7 | 34.8 |
| Samples 2 | 0.4 | 9.7 | 83.0 | 1.6 | 11.5 | 11.1 | 0.4 | 4.3 | 4.9 | 3.8 | 83.2 |
| Samples 3 | 0.7 | 9.5 | 133.7 | 1.5 | 30.7 | 12.9 | 17.8 | 5.9 | 13.6 | 10.6 | 57.2 |
| Samples 4 | 1.1 | 9.4 | 181.7 | 1.8 | 47.9 | 18.0 | 29.9 | 7.2 | 22.3 | 17.9 | 32.4 |
| Samples 5 | 1.5 | 9.4 | 198.5 | 1.4 | 52.6 | 21.4 | 31.2 | 7.6 | 21.9 | 17.3 | 28.7 |
| Average | 1.0 | 9.5 | 157.4 | 1.7 | 38.0 | 17.0 | 21.0 | 6.4 | 16.5 | 13.1 | 47.2 |
| Standard Deviation (STDEV) | 0.4 | 0.1 | 48.6 | 0.3 | 17.0 | 4.8 | 12.7 | 1.4 | 7.4 | 5.9 | 23.0 |
| Min | 0.4 | 9.4 | 83.0 | 1.4 | 11.5 | 11.1 | 0.4 | 4.3 | 4.9 | 3.8 | 28.7 |
| Max | 1.5 | 9.7 | 198.5 | 2.2 | 52.6 | 21.4 | 31.2 | 7.6 | 22.3 | 17.9 | 83.2 |
| Coefficient of Variation (CV) | 41.3 | 1.3 | 30.9 | 19.3 | 44.7 | 28.2 | 60.2 | 21.5 | 44.7 | 45.5 | 48.6 |

With regard to Tables 11-14, Set 1 samples (mold cooling lines) showed the highest amount of active clay and carbon: average active clay % for the 5 day span was 27%; the set also had the highest amount of dead clay as well (40%); this set also has the highest amount of metallic content. The metallic pieces appear slightly different than previously seen metallic content in other samples, i.e., longer more spear-like, which be due to thin runs of metal from pouring.

With regard to Tables 11-14, samples from Set 2 (Return Sand belts), showed the lowest amount of total clay and active clay. The variation in the active clay content was highest for this set, the first sampling showed active clay values of about half of subsequent days.

With regard to Tables 11-14, samples from Set 3 (gate & sprue conveyor, return shake out sand elevator, sand return belts) and Set 4 (gate and sprue conveyors, mold cooling, return sand belts, mag drum) have similar results. In these Sets, the Set 3, Set 4 active clay is not as high as Set 1 (17-18% vs. 27%), but there is also much less dead clay (19-21% vs. 40%).

Table 15 shows the composition of plow-off belt samples of sand (see stream 14 in FIG. 2) taken over about a two month period.

TABLE 15

Composition of Plow-off Belt Samples (Sand) taken over time

| Description | AFS GFN | % Metallic Content | % Total Clay | % Active Clay | % Dead Clay | % Sand | % Resin | % Carbon | % Total |
|---|---|---|---|---|---|---|---|---|---|
| Sample 1 | 48.5 | 1.0 | 11.6 | 5.8 | 5.8 | 83.9 | 1.3 | 2.2 | 100.0 |
| Sample 2 | 48.6 | 1.1 | 13.1 | 6.7 | 6.4 | 81.7 | 1.4 | 2.7 | 100.0 |
| Sample 3 | 49.2 | 0.2 | 12.8 | 6.2 | 6.6 | 83.1 | 1.3 | 2.6 | 100.0 |
| Sample 4 | 45.8 | 0.7 | 11.4 | 6.5 | 4.9 | 84.6 | 1.1 | 2.3 | 100.0 |
| Sample 5 | 46.0 | 0.7 | 13.3 | 8.6 | 4.7 | 82.4 | 1.2 | 2.4 | 100.0 |
| Sample 6 | 48.4 | 0.5 | 11.3 | 7.7 | 3.6 | 84.6 | 1.3 | 2.3 | 100.0 |
| Sample 7 | 50.8 | 1.4 | 14.8 | 8.3 | 6.5 | 80.0 | 1.2 | 2.6 | 100.0 |

Table 16 shows a comparison of sand samples of Plant A at various stages before, after, and after first stage of Mechanical Reclamation (MR) of FIG. 1.

TABLE 16

Comparison of sand samples of Plant A at various stages before, after, and after first stage of Mechanical Reclamation (MR)

| Description | AFS GFN | % Metallic Content | % Total Clay | % Active Clay | % Dead Clay | % Sand | % Resin | % Carbon | % Total |
|---|---|---|---|---|---|---|---|---|---|
| Before Oven | 64.0 | 0.3 | 5.7 | 3.5 | 2.2 | 92.0 | 0.9 | 1.1 | 100.0 |
| Before 1st MR | 56.4 | 0.2 | 9.0 | 5.2 | 3.8 | 87.5 | 1.3 | 1.9 | 100.0 |
| Before 1st Stage MR after Magnetic Separation | 50.7 | 0.2 | 9.6 | 5.1 | 4.5 | 87.0 | 1.1 | 2.2 | 100.0 |
| After 1st MR | 59.6 | 0.3 | 6.1 | 3.5 | 2.6 | 91.2 | 1.0 | 1.4 | 100.0 |
| After 1st stage MR | 64.4 | 3.0 | 2.6 | 1.2 | 1.4 | 93.0 | 0.6 | 0.8 | 100.0 |
| 1st Stage MR Accepted Sand | 58.0 | 0.2 | 2.0 | 1.7 | 0.3 | 96.9 | 0.3 | 0.6 | 100.0 |
| 1st Stage MR Accepted Sand | 55.5 | 0.1 | 3.9 | 2.9 | 1.0 | 94.7 | 0.6 | 0.8 | 100.0 |
| 1st Stage Mechanical Accepted Sand | 53.6 | 0.2 | 6.1 | 4.1 | 2.0 | 91.4 | 0.9 | 1.4 | 100.0 |

Table 17 shows characterization data of samples of sand and dust effluent from Plants A and B.

TABLE 17

Characterization Data of samples of sand and dust effluent from Plants A and B

| Description | AS Received Moisture | % Metallic content | AFS GFN | AFS Total Clay | AFS Active Clay | pH | % VCM | % LOI | % Carbon |
|---|---|---|---|---|---|---|---|---|---|
| Sand from Plant A | 1.2 | 0.9 | 50.8 | 14.8 | 8.3 | 9.9 | 2.1 | 4.2 | 2.6 |
| Dust from Plant A | 1.2 | 17.9 | 130.4 | 28.3 | 10.8 | 10.1 | 3.3 | 4.6 | 5.2 |
| Dust from Plant B | 13.1 | 2.7 | 56.1 | 18.1 | 8.1 | 9.2 | 2.9 | 5.9 | 1.3 |

TABLE 17-continued

| Characterization Data of samples of sand and dust effluent from Plants A and B | | | | | | | | | |
|---|---|---|---|---|---|---|---|---|---|
| Description | AS Received Moisture | % Metallic content | AFS GFN | AFS Total Clay | AFS Active Clay | pH | % VCM | % LOI | % Carbon |
| Sand from Plant B | 0.9 | 0.5 | 48.7 | 9.4 | 6.9 | 9.4 | 2.1 | 3.4 | 2.1 |

Dust from Plant A shows significant amount of magnetic fines
Dust from Plant B was received wet Table 18 shows characterization of data of sand and dust samples after AFS clay wash.

TABLE 18

| Characterization Data of sand and dust samples After AFS Clay Wash | | | | | | | |
|---|---|---|---|---|---|---|---|
| Description | % Metallic content | AFS GFN | AFS Total Clay % | AFS Active Clay % | % VCM | % LOI | % Carbon |
| Sand from Plant A | 1.1 | 61.2 | — | <1.0 | 1.2 | 1.7 | 1.6 |
| Dust from Plant A | 25.0 | 118.9 | — | <1.0 | 3.3 | 2.9 | 2.9 |
| Dust from Plant B | 3.3 | 87.3 | — | <1.0 | 1.7 | 3.4 | 2.6 |
| Sand from Plant | 0.6 | 59.3 | — | <1.0 | 1.3 | 1.1 | 2.3 |

Table 19 shows composition of sand and dust samples from Plants A, B, C, and D.

TABLE 19

| Composition of sand and dust samples | | | | | | | | |
|---|---|---|---|---|---|---|---|---|
| Description | % Metallic Content | % Total Clay | % Active Clay | % Dead Clay | % Sand | % Resin | % Carbon | % Total |
| Sand from Plant A | 0.9 | 14.8 | 8.3 | 6.5 | 80.5 | 1.2 | 2.6 | 100.0 |
| Dust from Plant B | 17.9 | 28.3 | 10.8 | 17.5 | 45.3 | 3.3 | 5.2 | 100.0 |
| Dust from Plant C | 2.7 | 18.1 | 8.1 | 10.0 | 76.2 | 1.7 | 1.3 | 100.0 |
| Sand from Plant D | 0.5 | 9.4 | 6.9 | 2.5 | 86.6 | 1.3 | 2.1 | 100.0 |

Note:
Resin % values are calculated from VCM % on washed samples

Table 20 shows composition of belt samples (sand) before Mechanical Reclamation taken over time for Plant B.

TABLE 20

| Composition of Belt Samples (Sand) before Mechanical Reclamation taken over time for Plant B | | | | | | | | | |
|---|---|---|---|---|---|---|---|---|---|
| Description | AFS GFN | % Metallic Content | % Total Clay | % Active Clay | % Dead Clay | % Sand | % Resin | % Carbon | % Total |
| Belt 1 | 49.7 | 0.4 | 10.6 | 6.5 | 4.1 | 85.1 | 1.3 | 2.7 | 100.0 |
| Belt 2 | 51.5 | 0.1 | 10.7 | 6.9 | 3.8 | 84.7 | 1.1 | 2.6 | 100.0 |
| Belt 3 | 52.9 | 0.5 | 10.6 | 6.5 | 4.1 | 85.5 | 1.2 | 2.3 | 100.0 |
| Belt 4 | 49.4 | 0.5 | 11.0 | 6.9 | 4.1 | 85.0 | 1.1 | 2.4 | 100.0 |
| Belt 5 | 48.9 | 0.7 | 10.0 | 6.9 | 3.1 | 85.8 | 1.1 | 2.4 | 100.0 |
| Belt 6 | 50.8 | 0.6 | 10.6 | 6.9 | 3.7 | 85.3 | 1.1 | 2.4 | 100.0 |
| Belt 7 | 48.7 | 0.5 | 9.4 | 6.9 | 2.5 | 86.6 | 1.3 | 2.1 | 100.0 |

Table 21 shows composition of samples (Dust) from Plant B over time.

TABLE 21

| Composition of samples (Dust) from Plant B over time | | | | | | | | | |
|---|---|---|---|---|---|---|---|---|---|
| Description | AFS GFN | % Metallic Content | % Total Clay | % Active Clay | % Dead Clay | % Sand | % Resin | % Carbon | % Total |
| Mixer | 137.5 | 9.7 | 26.9 | 8.3 | 18.6 | 56.2 | 1.3 | 5.9 | 100.0 |
| Hopper | 111.8 | 3.1 | 20.4 | 6.5 | 13.9 | 70.8 | 1.3 | 4.3 | 100.0 |
| Hopper | 88.4 | 3.7 | 16.8 | 6.0 | 10.8 | 74.1 | 1.4 | 4.0 | 100.0 |
| Mixer | 67.7 | 9.6 | 5.1 | 3.8 | 1.3 | 83.5 | 0.5 | 1.3 | 100.0 |
| Mixer | 74.2 | 5.5 | 6.3 | 3.1 | 3.2 | 85.8 | 0.8 | 1.6 | 100.0 |
| Mixer | 78.8 | 7.9 | 8.6 | 3.4 | 5.2 | 80.7 | 0.6 | 2.2 | 100.0 |
| Mixer | 66.0 | 8.4 | 4.6 | 3.8 | 0.8 | 85.4 | 0.4 | 1.2 | 100.0 |
| Mixer | 65.6 | 1.1 | 8.7 | 2.9 | 5.8 | 88.4 | 0.5 | 1.3 | 100.0 |
| Sample | 56.1 | 2.7 | 18.1 | 8.1 | 10.0 | 76.2 | 1.7 | 1.3 | 100.0 |

Table 22 shows free swell and cation exchange capacity property subject to calcination.

TABLE 22

Free Swell and Cation Exchange Capacity Property Subject to Calcination (DC-2 Bentonite Clay)

| Material | Calcination Temperature ° C./° F. | Free Swell mL | CEC meq/100 g |
|---|---|---|---|
| DC-2 | Control | 23 | 100 |
| | 400/752 | 28 | 98 |
| | 500/932 | 22 | 94 |
| | 600/1112 | 6 | 82 |
| | 700/1292 | 3 | 38 |

Calcination Conditions: 30-minute at the desired Temperature

Figure 12:
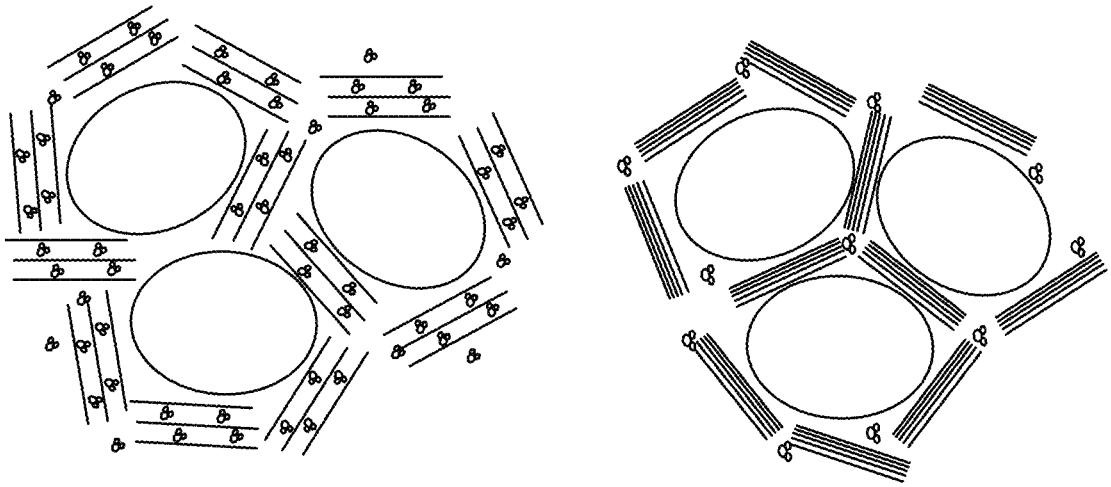
FIG. 12 illustrates bonding of sand particles with active and "dead" bentonite clay particles.
Figure 12:
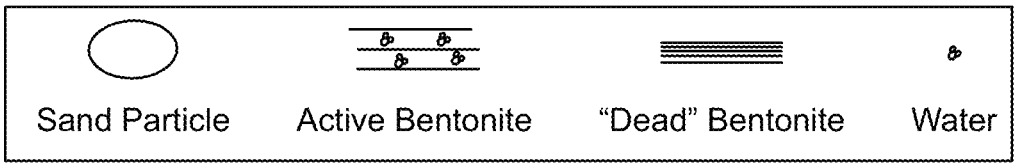

FIG. 12 illustrates bonding of sand particles with active and "dead" bentonite clay particles. There is more water sorption and swelling with active clay particles, which results in fewer clay particles between sand particles and higher more binding strength. There is less water sorption and swelling with dead clay particles, which results in more clay particles between sand particles and lower more binding strength.

Table 23 shows cost and mass balances for sand and Additrol® for three exemplary plants (e.g., FIG. 1). Streams were sampled and the samples were analyzed. The sand component is both a significantly higher volume and much greater economic value than active clay.

TABLE 23 shows cost and mass balances for sand and Additrol ® for three exemplary plants (e.g., FIG. 1).

| | Influent Sand at $50/ton | | Influent Additrol ® at $300/ton | | Effluent Sand for Stream of Interest | | Effluent Total Clay for Stream of Interest | | Effluent Active Clay for Stream of Interest | |
|---|---|---|---|---|---|---|---|---|---|---|
| Customer Number | Volume T/D | Cost ($/D) | Volume T/D | Cost ($/D) | Volume T/D | Cost ($/D) | Volume T/D | Cost ($/D) | Volume T/D | Cost ($/D) |
| 1 | 150 | $7,500 | 84 | $25,200 | 130 | $6,500 | 25 | NM | 9.5 | $2,850 |
| 2 | 145 | $7,250 | 38 | $11,400 | 80 | $4,000 | 14 | NM | 7.5 | $2,250 |
| 3 | 288 | $14,400 | 80 | $24,000 | 280 | $14,000 | 70 | NM | 20 | $6,000 |

Table 24 shows analysis of bag house dust Samples. System mass and cost balances may be conducted to determine potential reclamation benefit compared to current landfilling cost.

TABLE 24

Analysis of Baghouse Dust Samples

| Line | Metallic Content, % | Sand, % | Total Clay, % | Active Clay, % | Dead Clay, % | Resin, % | Carbon, % |
|---|---|---|---|---|---|---|---|
| 7048 | 1.0 | 26.2 | 53.1 | 28.1 | 25.0 | 7.7 | 12.0 |
| Silo | 0.9 | 38.9 | 42.5 | 33.8 | 8.7 | 7.0 | 10.6 |

Table 25 shows analysis of monthly greensand samples from a plant. System mass and cost balances may be conducted to determine potential reclamation benefit compared to current landfilling cost.

TABLE 25

Analysis of Monthly Greensand Samples

| Line | Moist., % | AFS GFN | Estimated Sand, % | Total Clay, % | Active Clay, % | Dead Clay, % | VCM, % | LOI, % | Carbon, % |
|---|---|---|---|---|---|---|---|---|---|
| Line AB | 4.0 | 60.5 | 80 | 13.2 | 11.0 | 2.2 | 2.2 | 4.4 | NA |
| STD Dev | 0.2 | 2.4 | NA | 1.1 | 0.5 | NA | 0.4 | 0.6 | NA |
| Coeff of Variation | 4.6 | 3.9 | NA | 8.1 | 4.2 | NA | 18.0 | 14.2 | NA |
| Line CD | 3.9 | 61.6 | 80 | 13.0 | 11.1 | 2.0 | 2.1 | 4.3 | NA |
| STD Dev | 0.2 | 3.2 | NA | 0.8 | 0.6 | NA | 0.2 | 0.4 | NA |
| Coeff of Variation | 5.7 | 10.3 | NA | 5.9 | 5.0 | NA | 9.6 | 10.3 | NA |

Prophetic Examples

All inventive reclamation units will be sized to the water demand of the foundry mullers and cooling circuit.

In an exemplary plant, install facility to process dust streams from the plant and feed blackwater containing active clay to mullers and sand cooling circuit. The sand fines and dead clay would go to disposal.

In Plant A, install unit to intercept influent to the Mechanical Reclamation. The blackwater effluent containing active clay would feed the mullers and sand cooling circuit. The sand from the inventive reclamation unit would have moisture removed (dryer/vacuum) and go into Mechanical Reclamation.

In an exemplary plant, install unit to recover active clay from sand based effluent and return it via blackwater to mullers. Additionally, unit operations would recover the clean sand, remove moisture (dryer), and feed back to the plant core room.

Definitions

A "hydrocyclone" (often referred to by the shortened form cyclone) is a device to classify, separate or sort particles in a liquid suspension based on the ratio of their centripetal force to fluid resistance. This ratio is high for dense (where separation by density is required) and coarse (where separation by size is required) particles, and low for light and fine particles. Hydrocyclones also find application in the separation of liquids of different densities.

A "hammermill" is a mill whose purpose is to shred or crush aggregate material into smaller pieces by the repeated blows of little hammers. A hammermill may be a steel drum containing a vertical or horizontal rotating shaft or drum on which hammers are mounted. The hammers are free to swing on the ends of the cross, or fixed to the central rotor. The rotor is spun at a high speed inside the drum while material is fed into a feed hopper. The material is impacted by the hammer bars and is thereby shredded and expelled through screens in the drum of a selected size.

"Magnetic separation" is a process in which magnetically susceptible material is extracted from a mixture using a magnetic force. It may include pairs of magnets that draw off magnetised particles. Different pairs of magnets may be configured to have different degrees of magnetization to draw off different types of particles.

Unless otherwise specified, a percent composition is weight percent.

While particular embodiments of the present invention have been shown and described, it will be obvious to those skilled in the art that changes and modifications can be made without departing from this invention in its broader aspects. Therefore, the appended claims are to encompass within their scope all such changes and modifications as fall within the true spirit and scope of this invention.

What is claimed is:

1. A method of reclaiming clean sand and active clay from foundry waste comprising:

providing dust and sand from a molding process in a foundry, wherein the dust and sand comprise clay, the clay comprising active clay and dead clay;

rinsing a slurry comprising the dust and sand to remove clay from the sand and dust, wherein the rinsing comprises rinsing the slurry at least one time, wherein the clay is separated as a first clay slurry;

removing additional clay from the rinsed slurry by shaking the rinsed slurry on a shaker table, wherein the additional clay is separated as a second clay slurry, wherein a clean sand slurry is removed from an end of the shaker table;

allowing the dead clay to separate as solids from the first and the second clay slurries to form an active clay slurry;

recycling the active clay slurry to a muller in the foundry; and recycling clean sand from the clean sand slurry to the foundry.

2. The method of claim 1, wherein the slurry is formed in a slurry tank, and optionally, at least a portion of the active clay slurry is recycled to the slurry tank.

3. The method of claim 1, wherein the slurry is 10 to 60 wt % solids.

4. The method of claim 1, wherein the rinsing comprises rinsing the slurry only one time, or the rinsing comprises rinsing the slurry 2 to 5 times.

5. The method of claim 1, wherein the rinsing and shaking are performed in a rinser/shaker unit.

6. The method of claim 1, wherein at least one rinse is performed with fresh water, and/or at least one rinse is performed with the active clay slurry recycled to the rinsing.

7. The method of claim 1, wherein the first and second clay slurries are fed to a flotation/settling tank to allow the dead clay to settle as solids.

8. The method of claim 1, wherein the clean sand slurry is fed to a sand drier which removes water to form the clean sand for recycling to the foundry, and optionally, the clean sand is fed to core forming in a foundry without mechanical reclamation.

9. The method of claim 1, wherein the clean sand is fed to a mechanical reclamation unit and then fed to core forming in the foundry.

10. The method of claim 1, wherein a concentration of clay in the clean sand is 1-3%.

* * * * *